US008089741B2

(12) United States Patent
Wang et al.

(10) Patent No.: US 8,089,741 B2
(45) Date of Patent: Jan. 3, 2012

(54) OVER-VOLTAGE PROTECTION DEVICE AND METHOD FOR MANUFACTURING THEREOF

(75) Inventors: Chung-Hsiung Wang, Hsin Chu (TW); Hung-Ming Lin, Hsinchu County (TW); Kuo-Shu Chen, Tao-Yuan (TW); Wen-Shiang Luo, Taipei (TW)

(73) Assignee: Cyntec Co., Ltd., Hsin-Chu (TW)

( * ) Notice: Subject to any disclaimer, the term of this patent is extended or adjusted under 35 U.S.C. 154(b) by 407 days.

(21) Appl. No.: 12/509,484

(22) Filed: Jul. 26, 2009

(65) Prior Publication Data

US 2010/0134937 A1 Jun. 3, 2010

(30) Foreign Application Priority Data

Nov. 28, 2008 (TW) ..... 97146389 A

(51) Int. Cl.
*H02H 3/20* (2006.01)
*H02H 9/04* (2006.01)
*H02H 7/20* (2006.01)

(52) U.S. Cl. ..... 361/91.1; 361/112

(58) Field of Classification Search ..... 361/91.1
See application file for complete search history.

(56) References Cited

U.S. PATENT DOCUMENTS

| | | | | |
|---|---|---|---|---|
| 4,098,917 | A * | 7/1978 | Bullock et al. | 427/534 |
| 6,537,867 | B1 * | 3/2003 | Freyman et al. | 438/197 |
| 2007/0020822 | A1 * | 1/2007 | Chou et al. | 438/149 |

FOREIGN PATENT DOCUMENTS

| | | | |
|---|---|---|---|
| CN | 101202422 | A | 6/2008 |
| TW | I253881 | B | 4/2006 |
| TW | M336534 | | 7/2008 |
| TW | I303477 | | 11/2008 |

* cited by examiner

*Primary Examiner* — Dharti Patel
(74) *Attorney, Agent, or Firm* — Stout, Uxa, Buyan & Mullins, LLP

(57) ABSTRACT

An over-voltage protection device and a method for manufacturing the over-voltage protection device are provided. The over-voltage protection device includes a substrate, a pair of electrode layers, a mask layer, and a sealing layer. The electrode layers are disposed on the substrate, and a gap is formed between the electrode layers. The mask layer is disposed over the gap and a portion of the electrode layers. The sealing layer covers the mask layer and the gap.

20 Claims, 21 Drawing Sheets

OVER-VOLTAGE PROTECTION DEVICE AND METHOD FOR MANUFACTURING THEREOF

CROSS-REFERENCE TO RELATED APPLICATIONS

The entire contents of Taiwan Patent Application No. 097146389, filed on Nov. 28, 2008, from which this application claims priority, are incorporated herein by reference.

BACKGROUND OF THE INVENTION

1. Field of the Invention

The present invention generally relates to a passive component in an electrical system, and more particularly to an over-voltage protection device and a method for manufacturing the over-voltage protection device.

2. Description of the Prior Art

Over-voltage protection devices are widely used in electrical systems and electrical communication equipment for preventing elements thereof from being damaged by abnormal voltage or electro-static discharge (ESD) surges. Conventionally, the over-voltage protection device, as a varistor, is parallel connected with an electric source and has a variable resistance for conveniently facilitating adjustment of current flow or voltage. When the over-voltage protection device is in a normal state, it has a large electric resistance whereby current will not flow through the protection device. When the voltage of the electric source goes higher than a critical voltage of the over-voltage protection device, the electric resistance of the over-voltage protection device decreases quickly such that the large voltage of the electric source is directed to ground through the over-voltage protection device so as to prevent the other electrical elements from being damaged by the large voltage.

There are many kinds of over-voltage protection devices with the gap discharge type being the most widely used, as an ESD suppressor. The gap discharge type over-voltage protection device has a gap between two metal electrodes, the gap having a dimension of about several micrometers. When a large voltage appears between the metal electrodes, air within the gap is ionized so as to conduct an electric current between the metal electrodes causing the large voltage to be directed to ground so as to prevent the other electrical elements from being damaged. The gap should be maintained free of material other than air to protect against reductions in the stability of the withstanding voltage properties.

A conventional manufacturing method of the gap discharge type over-voltage protection device is disclosed in Taiwan Patent Application No. 200807673, in which the metal electrodes are formed by lithography and electroforming processes with curved shapes and a gap therebetween of about 0.5-10 μm. A proximity aligner is usually applied in the conventional lithography process. When using the proximity aligner, a suitable distance should be maintained between the mask and the substrate to prevent pollution of the mask from contact with the substrate. However, increasing the distance between the mask and the substrate increases a probability of light refraction and/or decreases a perpendicularity characteristic between the end edge of the metal electrode and the substrate. Normally, when using a positive photoresist, a profile of the positive photoresist near the substrate will be narrower with the profile of the positive photoresist farther away from the substrate being wider. On the other hand, use of a negative photoresist results in a wider profile of the negative photoresist near the substrate and a narrower profile of the negative photoresist farther away from the substrate. The electrode, which is formed by such a photoresist of poor perpendicularity, will also have a profile of poor perpendicularity. Therefore, the withstanding voltage properties of the over-voltage protection device will be unstable. Besides, the substrate used in the conventional manufacturing method is a thin aluminum oxide substrate which is made by a high temperature sintering process. Therefore, the substrate is likely to suffer from smoothness-control complications and warpage problems, with the profile of the electrode commensurately being affected by such substrate deficiencies.

Other approaches for forming the gap between the electrodes include the diamond sawing process and the laser cutting process. These processes are disclosed, for example, in Taiwan Patent Nos. M336534 and I1253881, according to which the gap between the electrodes can be controlled to 10-30 μm. However, if the gap is formed by the diamond sawing process or the laser cutting process, there is a risk that protrusions or burrs can be formed on the end edge of the electrode. The roughness of the end edge of the electrode is affected by the protrusions or burrs, resulting in a decrease in the stability of the withstanding voltage properties owing to the protrusions or burrs formed on the end edge of the electrode.

SUMMARY OF THE INVENTION

Accordingly, an object of the present invention is to provide a method for manufacturing an over-voltage protection device in which the metal electrode layer has an edge surface with a better perpendicularity so as to achieve better properties of the over-voltage protection device.

Another object of the present invention is to provide an over-voltage protection device and a method for manufacturing the over-voltage protection device to prevent materials other than air from being retained within the gap between the metal electrode layers so as to achieve better properties of the over-voltage protection device.

In order to achieve the above objects, the present invention provides an over-voltage protection device and a method for manufacturing the over-voltage protection device. The method includes providing a substrate, forming a first photoresist layer on the substrate, forming a patterned metal layer on the first photoresist layer, exposing and developing the first photoresist layer to expose a portion of the substrate whereby the patterned metal layer is used as a mask, removing the patterned metal layer, forming a pair of electrode layers on the exposed portion of the substrate whereby a gap is disposed between the electrode layers, and forming a sealing layer covering the gap.

According to the method mentioned above, the sealing layer can comprise a material with low rheological properties. In another embodiment, the sealing layer can comprise a material having low rheological properties and static conductive functions.

According to the method mentioned above, the step of forming the patterned metal layer on the first photoresist layer can include forming a metal layer on the first photoresist layer, forming a third photoresist layer on the metal layer, exposing and developing the third photoresist layer to expose a portion of the metal layer whereby the exposed portion of the metal layer has electrode patterns which are separated from and symmetrical to each other and which are substantially identical to the electrode layers, and removing the exposed metal layer to form the patterned metal layer.

In order to achieve the above objects, the present invention provides another over-voltage protection device and a method for manufacturing the over-voltage protection device. The over-voltage protection device can include a substrate, a pair of electrode layers disposed on the substrate with a gap present between the electrode layers, a mask layer disposed over the gap and a portion of the electrode layers, wherein a clearance exists between the mask layer and the electrode layers, and a sealing layer covering the mask layer and the gap.

The method for manufacturing the over-voltage protection device can include providing a substrate, forming a pair of electrode layers on the substrate, wherein a gap exists between the electrode layers, forming a mask layer over the gap and a portion of the electrode layers, and forming a sealing layer covering the mask layer and the gap.

DETAILED DESCRIPTION OF THE INVENTION

A detailed description of the present invention will be provided in connection with the following embodiments, which are not intended to limit the scope of the present invention, but which can be adapted for other applications. While the drawings are illustrated in detail, it is appreciated that the quantity of the disclosed components may be greater or less than that disclosed except for instances expressly restricting the amount of such components.

Figure 1A:
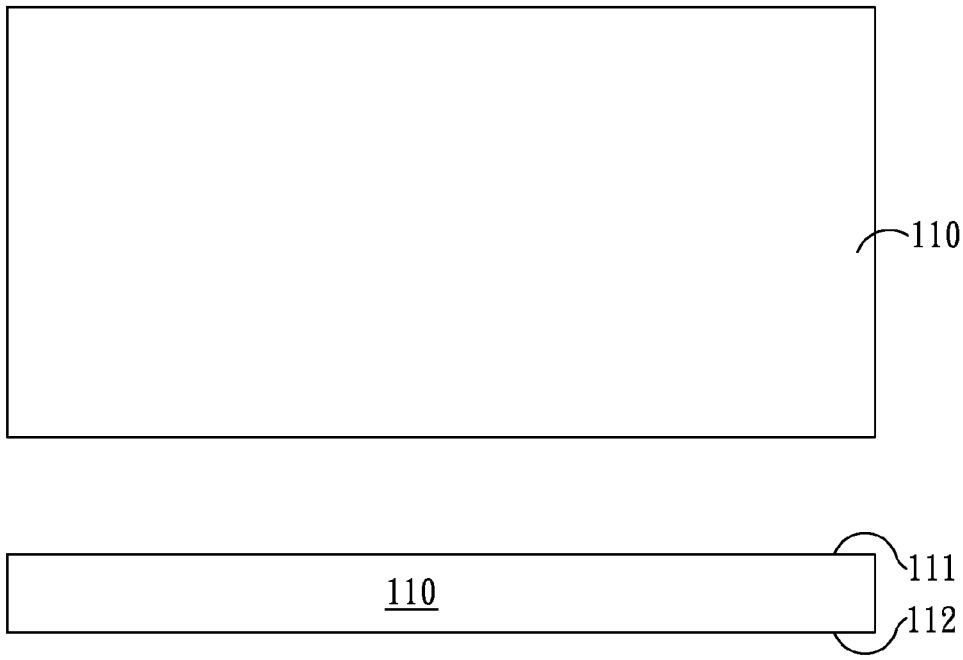
FIGS. 1A-1N depict a method for manufacturing an over-voltage protection device in accordance with a first embodiment of the present invention.
Figure 1B:
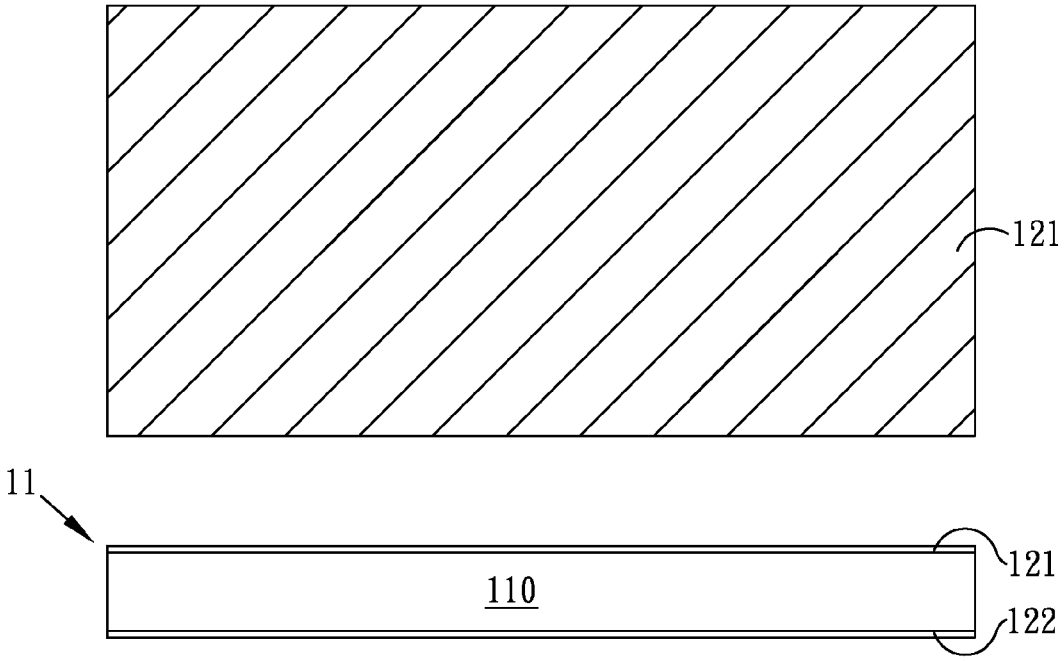
Figure 1C:
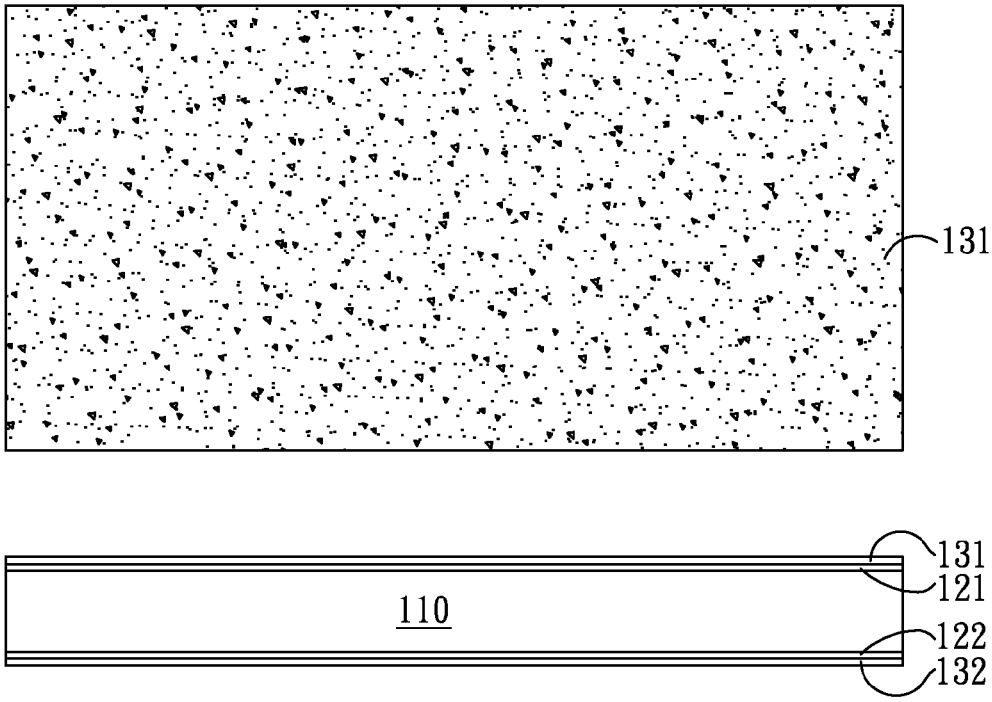
Figure 1D:
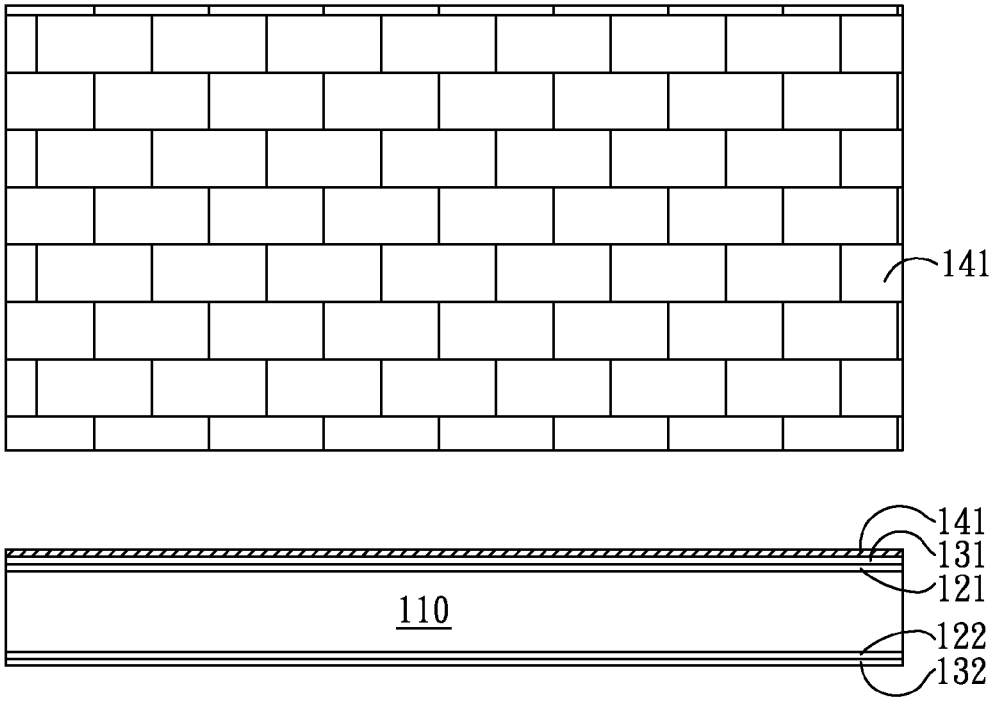
Figure 1E:
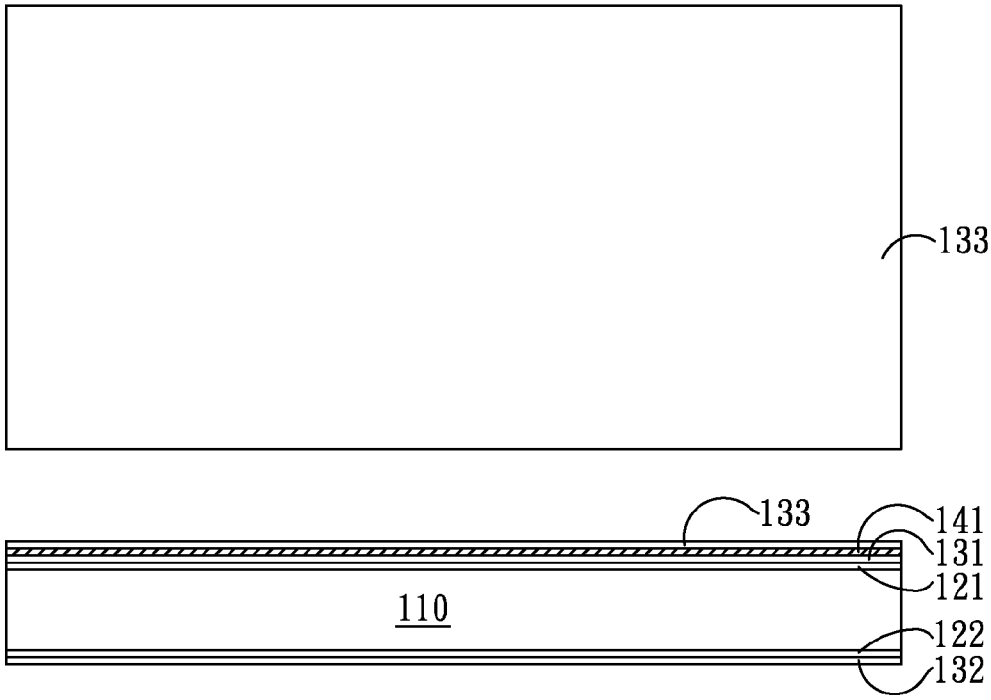
Figure 1F:
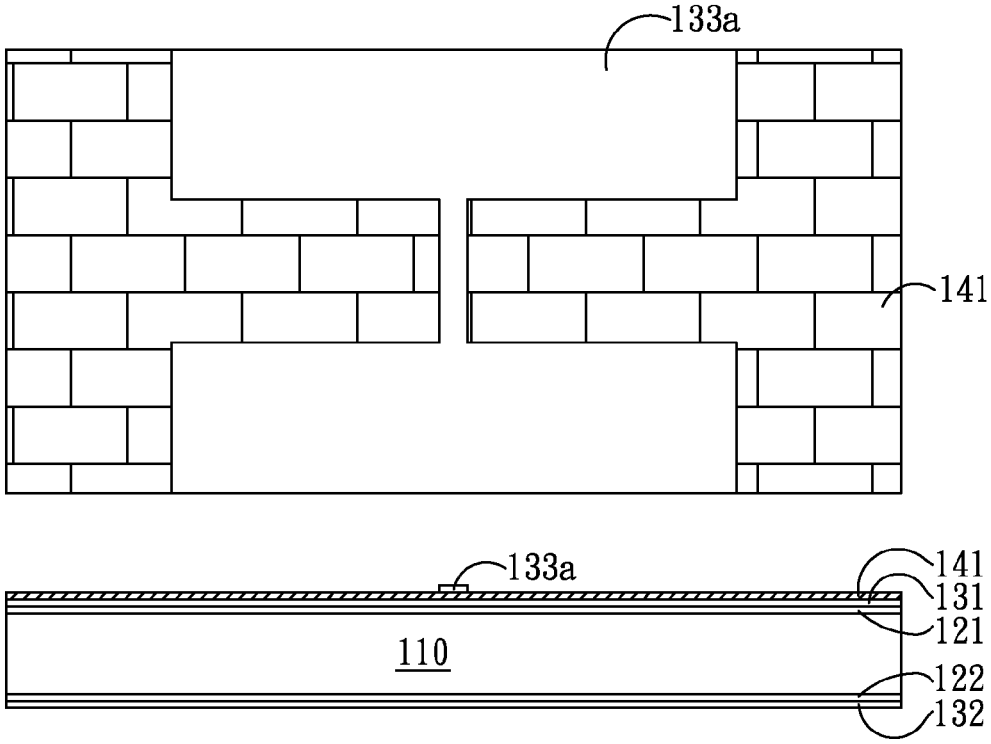
Figure 1G:
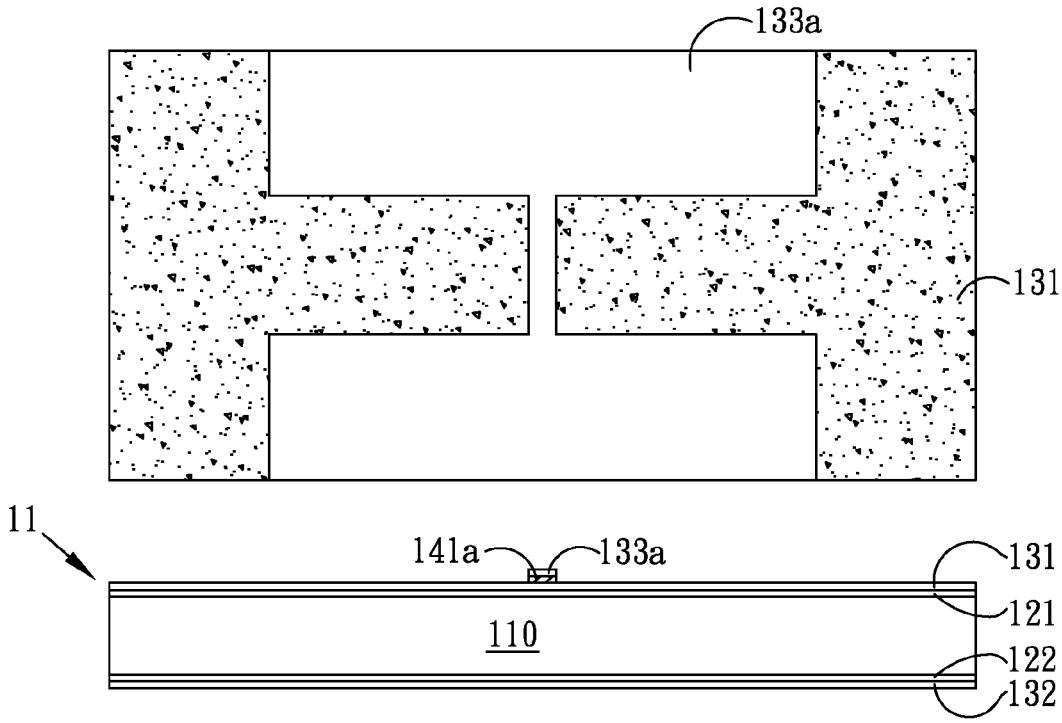
Figure 1H:
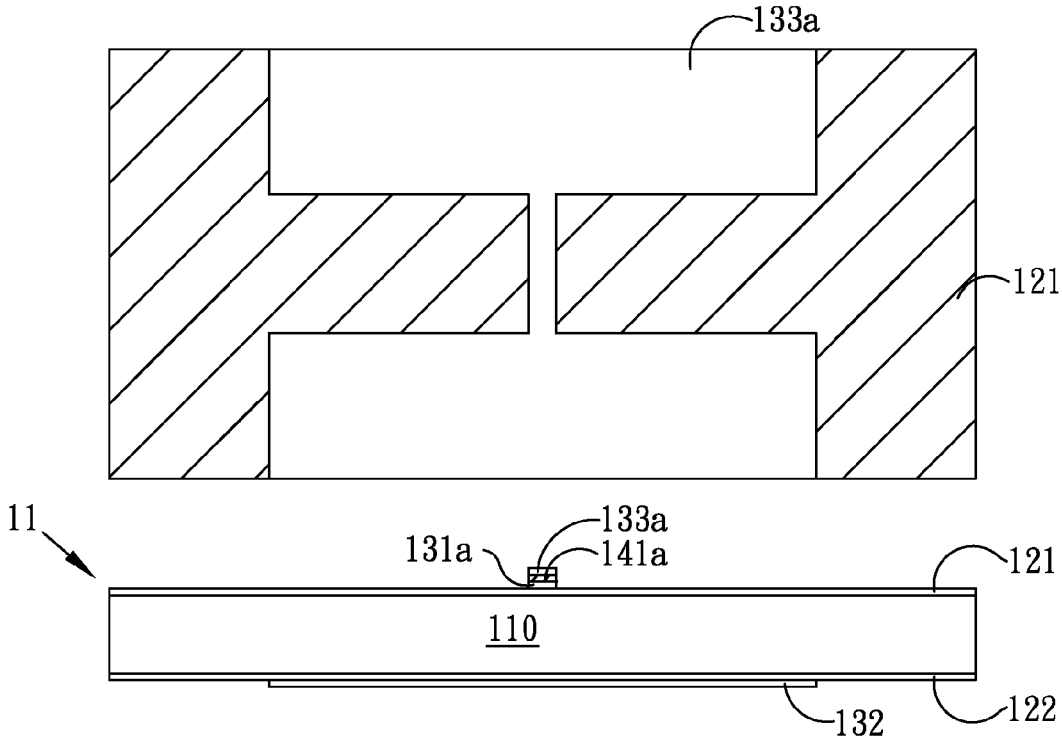
Figure 1I:
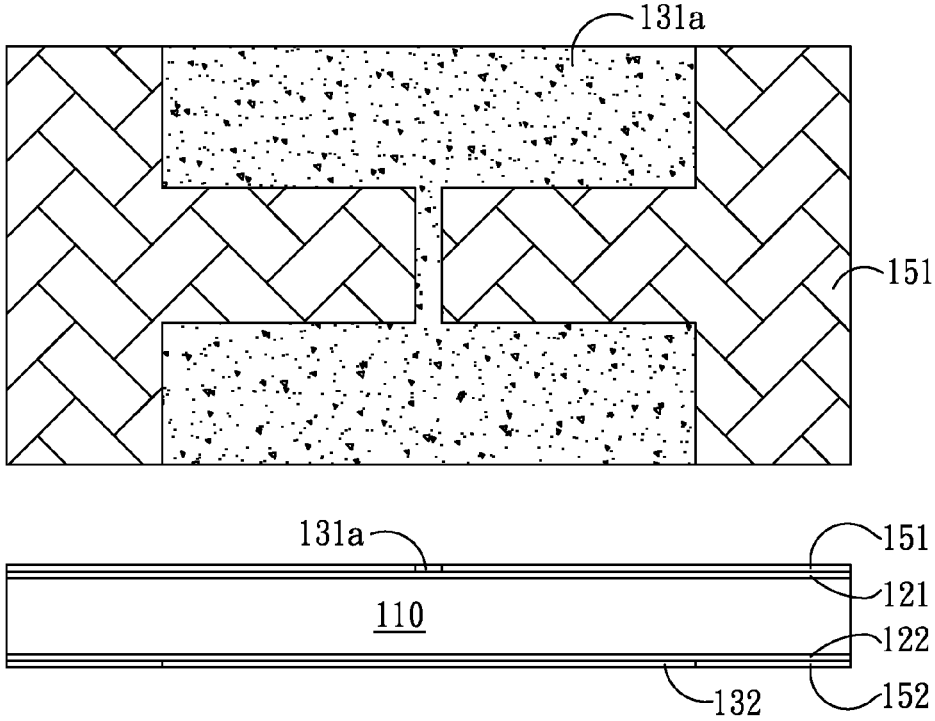
Figure 1J:
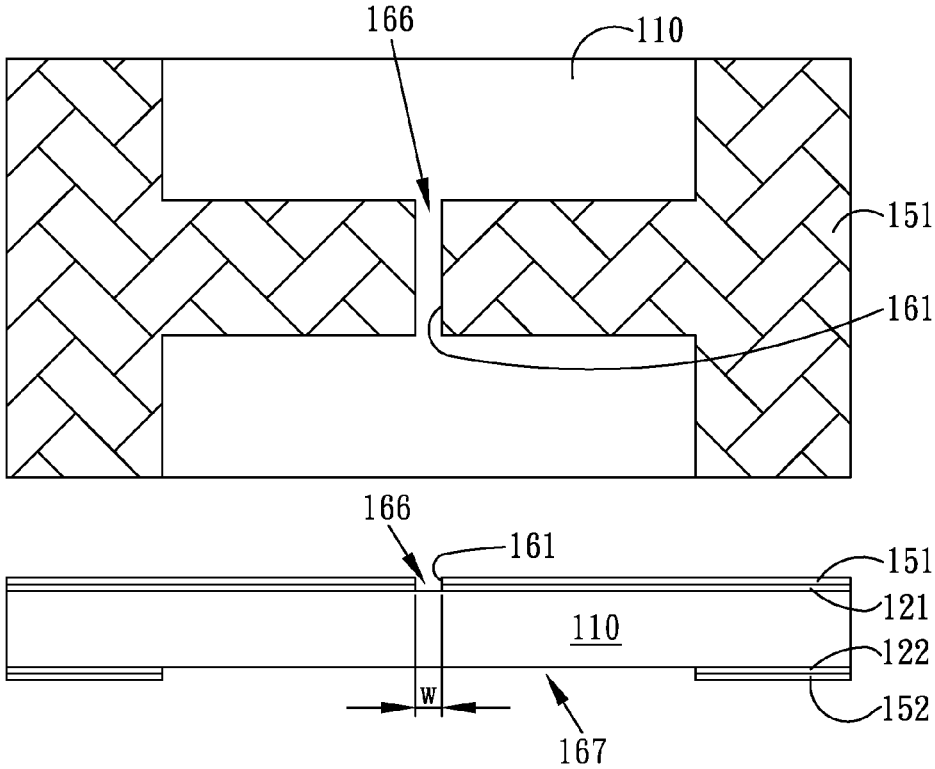
Figure 1K:
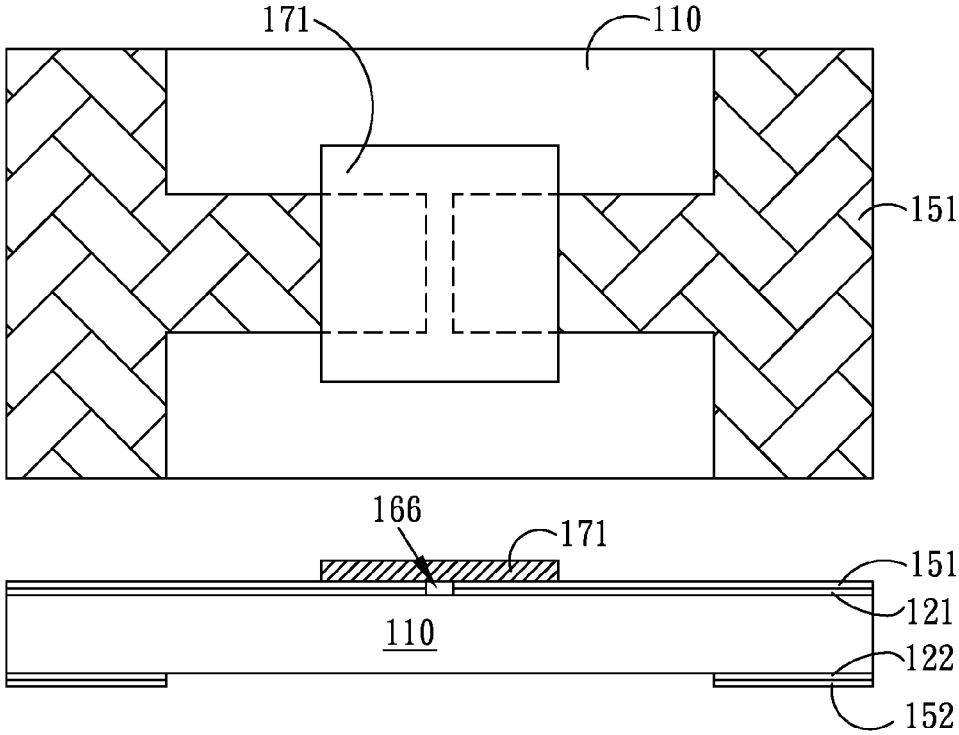
Figure 1L:
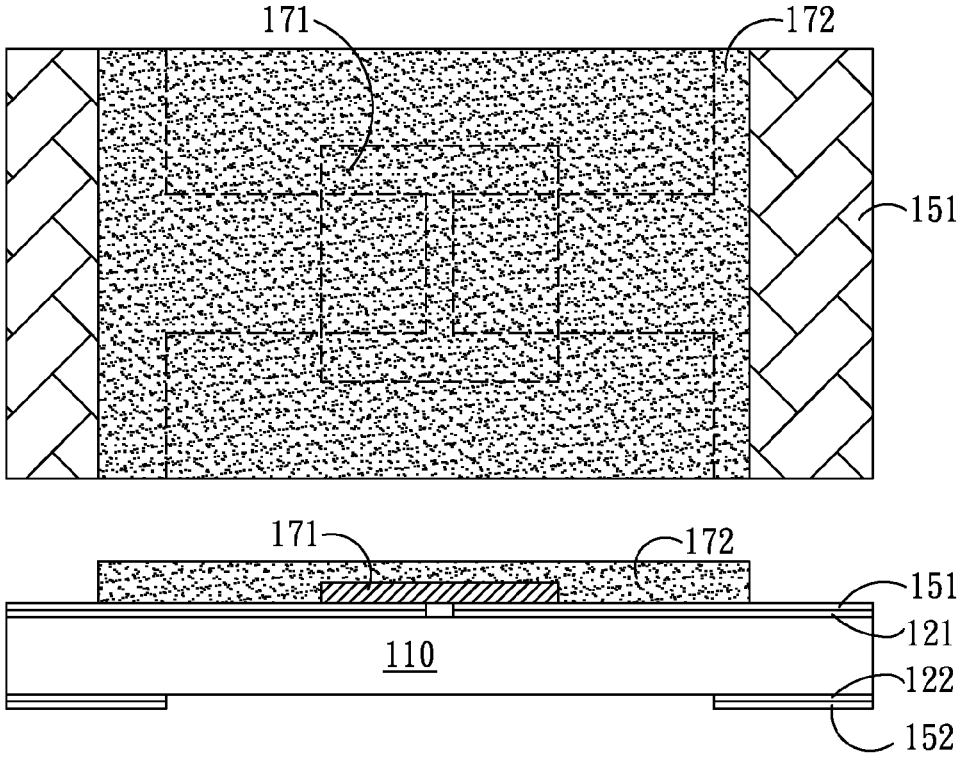
Figure 1M:
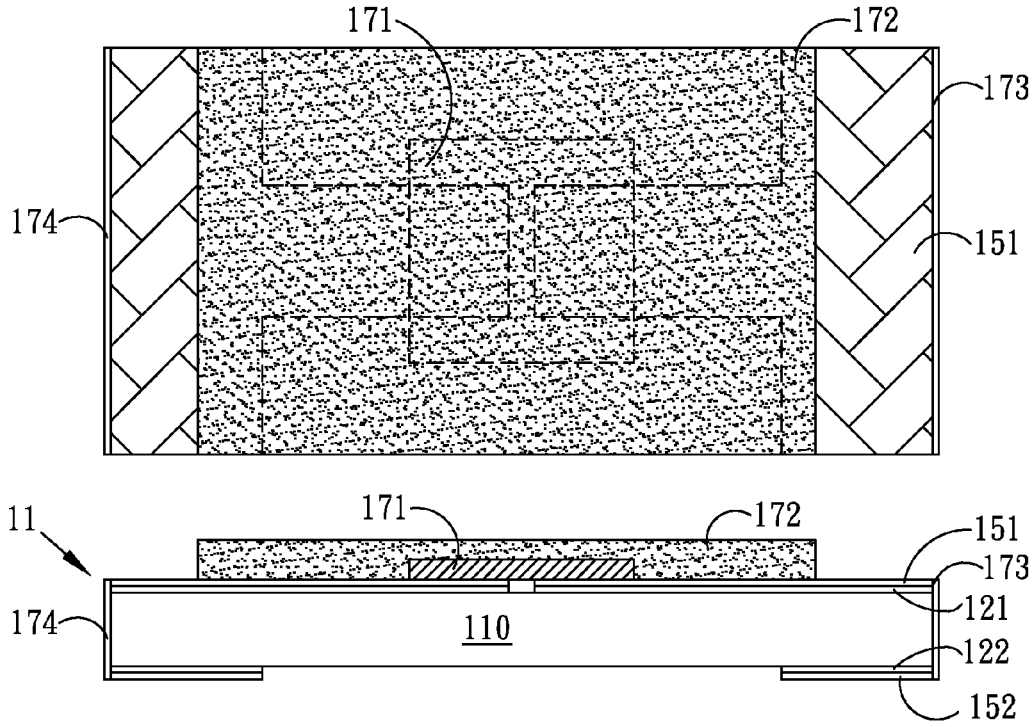
Figure 1N:
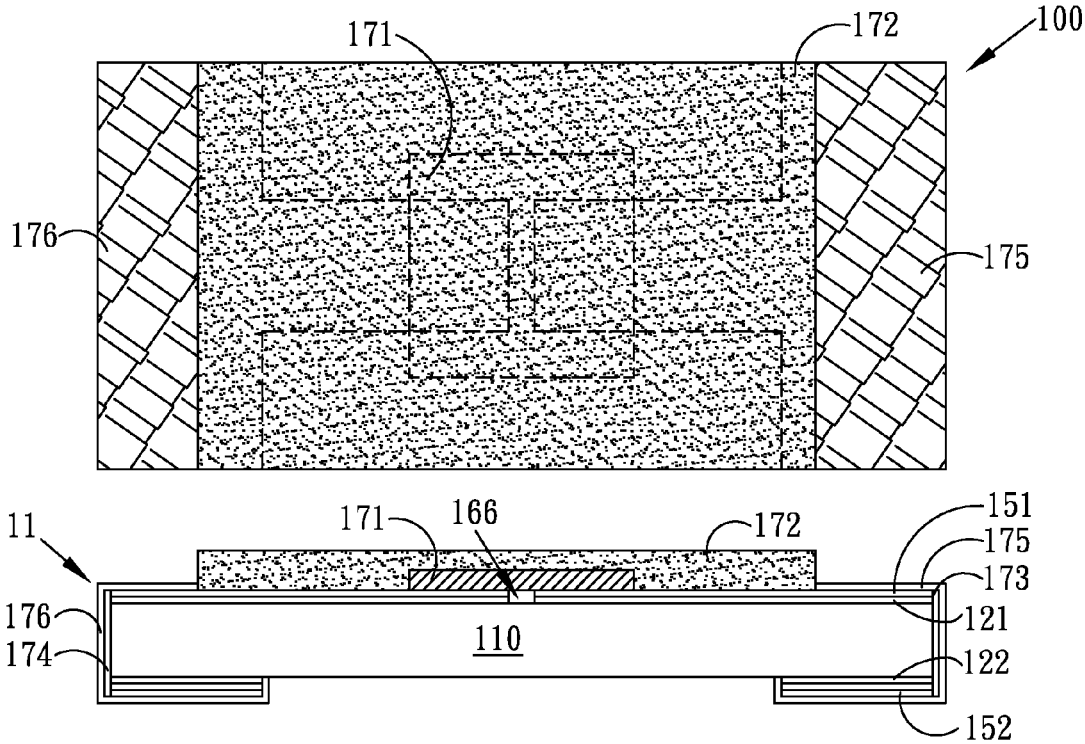

FIGS. 1A-1N depict a method for manufacturing an over-voltage protection device in accordance with a first embodiment of the present invention. The method for manufacturing an over-voltage protection device 100 includes (A) providing a substrate, (B) forming a first photoresist layer on the substrate, (C) forming a patterned metal layer on the first photoresist layer, (D) exposing and developing the first photoresist layer for exposing a portion of the substrate, wherein the patterned metal layer is used as a mask, (E) removing the patterned metal layer, (F) forming a pair of electrode layers on the exposed portion of the substrate, wherein a gap is disposed between the electrode layers, and (G) forming a sealing layer covering the gap. Particular steps of the method are described in the following paragraphs.

First, (A) providing a substrate 11, referring to FIG. 1A and FIG. 1B, the substrate 11 has a base plate 110, a first seed layer 121, and a second seed layer 122. The base plate 110 has a first surface 111 and a second surface 112. The base plate 110 can be an insulating substrate, such as an aluminum oxide substrate or an aluminum nitride substrate. The first seed layer 121 and the second seed layer 122 can be formed on the first surface 111 and the second surface 112 of the base plate 110. For example, the first seed layer 121 and the second seed layer 122 can be formed by a sputtering process. The material of the first seed layer 121 and the second seed layer 122 can be Ti—W alloy, Ni—Cr alloy, Cr, Ti, Ta, Ni—Cu alloy and so on; preferably the material of the first seed layer 121 and the second seed layer 122 can be different from the material of the electrode layer 151 and the bottom electrode layer 152 (as shown in FIG. 1I) which are formed later. Thus, when the seed layers are etched, the electrode layers will not be etched in the same time. In this embodiment, for example, the electrode layer 151 and the bottom electrode layer 152 are made of Cu, and the first seed layer 121 and the second seed layer 122 are made of Ti—W alloy. The thickness of the first seed layer 121 and the second seed layer 122 is about 0.05 μm to 0.4 μm. The first seed layer 121 and the second seed layer 122 are used for increasing the adhesion of the base plate 110 to the electrode layer 151 and the base plate 110 to the bottom electrode 152.

Then, (B) forming a first photoresist layer 131 on the substrate 11, referring to FIG. 1C, the first photoresist layer 131 is formed on the first seed layer 121. In this step, a second photoresist layer 132 can also be formed on the substrate 11, such as formed on the second seed layer 122. The thickness of the first photoresist layer 131 and the second photoresist layer 132 is about 10 μm to 30 μm, but the invention is not limited to this. The thickness of the first photoresist layer 131 is also able to be designed according to the thickness of the electrode layer 151; preferably the thickness of the first photoresist layer 131 can be equal to or bigger than the thickness of the electrode layer 151 (shown in FIG. 1I). In this embodiment, the first photoresist layer 131 is a positive photoresist.

Then, (C) forming a patterned metal layer 141*a* on the first photoresist layer 121, the steps of forming the patterned metal layer 141*a* are described with reference to FIGS. 1D-1G. First, referring to FIG. 1D, a metal layer 141 is formed on the first photoresist layer 131. In this embodiment, the metal layer 141 is a Cu layer that is formed on the first photoresist layer 121 by an evaporation process. The thickness of the Cu layer is about 0.03 μm to 0.1 μm. If the thickness of the Cu layer is too thin, the UV light will pass through the Cu layer during the exposing process. If the thickness of the Cu layer is too thick, there is a risk that over-etching or side etching may occur during the etching process. This is also a waste of the metal material. Therefore, preferably the thickness of the Cu layer is about 0.03 μm to 0.05 μm. The material of the metal layer 141 is not limited to Cu; the metal layer 141 can be made of other material and by other processes, such as Ti, Ta, Cr, Au, Al and so on. Preferably, the metal layer 141 is a Cu layer due to the following advantages. First, the process temperature of the evaporation process of Cu is lower than that of other materials, so that the properties of the first photoresist layer 131 and the second photoresist layer 132 will not be affected by the process temperature. Second, the material cost of the evaporation process of Cu is less expensive than that of other materials. Furthermore, the etching process of Cu is simpler and safer than that of other materials.

Then, referring to FIG. 1E, a third photoresist layer 133 is formed on the metal layer 141. The thickness of the third photoresist layer 133 is smaller than the thickness of the first photoresist layer 131. The thickness of the third photoresist layer 133 is about 0.5 μm to 3 μm. The third photoresist layer 133 having a smaller thickness can result in a better resolution of the lithography process. Then, referring to FIG. 1F, the third photoresist layer 133 is exposed and developed by the lithography process to form a patterned third photoresist layer 133*a* and expose a portion of the metal layer 141. In this embodiment the exposed portion of the metal layer 141 has the two electrode patterns which are separated from each other and symmetrical to each other with the electrode patterns being substantially identical to the electrode layers 151, but the invention is not limited to this. The third photoresist layer 133 can be a positive photoresist or a negative photoresist. In this embodiment, the third photoresist layer 133 is a positive photoresist so as to achieve better resolution than the negative photoresist. Then, referring to FIG. 1G, the patterned third photoresist layer 133*a* is used as a mask, and the exposed portion of the metal layer 141 is etched to form a patterned metal layer 141*a* and expose a portion of the first photoresist layer 131. After the etching process the exposed portion of the first photoresist layer 131 has the two electrode patterns which are separated from each other and symmetrical to each other, but the invention is not limited to this.

Then, referring to FIG. 1H, (D) the patterned metal layer 141*a* is used as a mask, and the first photoresist layer 131 is exposed and developed by the lithography process for removing the exposed portion of the first photoresist layer 131 to form a patterned first photoresist layer 131*a* and expose a portion of the substrate 11. The exposed portion of the substrate 11 has the two electrode patterns that are separated from each other and symmetrical to each other. In this embodiment, the exposed portion of the substrate 11 is a portion of the first seed layer 121 that is disposed on the substrate 11. Furthermore, the second photoresist layer 132 can be exposed and developed by another lithography process to form a patterned second photoresist layer 132*a* and expose a portion of the second seed layer 122. In this embodiment the first photoresist layer 131 and the second photoresist layer 132 are exposed and developed respectively, but the invention is not limited to this. One of ordinary skill in the art can understand that the first photoresist layer 131 and the second photoresist layer 132 can be exposed respectively, and then the first photoresist layer 131 and the second photoresist layer 132 can be developed together by the lithography process. The same concept applies elsewhere herein and is not mentioned again.

Then, referring to FIG. 1I, (E) the patterned metal layer 141*a* is removed and (F) a pair of electrode layers 151 is formed on the exposed portion of the substrate 11, wherein a gap 166 is disposed between the electrode layers 151 (as shown in FIG. 1J). In this embodiment, the patterned third photoresist layer 133*a* and the patterned metal layer 141*a* are removed, and then a metal layer is electroplated on the exposed portion of the first seed layer 121 to form the electrode layers 151 wherein the electrode layers 151 are separated from each other and symmetrical to each other. Otherwise, the bottom electrode layers 152 are formed on the exposed portion of the second seed layer 122. The electrode layers 151 are used as the upper electrodes of the over-voltage protection device 100, and the bottom electrode layers 152 are used as the lower electrodes of the over-voltage protection device 100. Preferably the thickness of the electrode layer 151 is smaller than the thickness of the patterned first photoresist layer 131*a*, and the thickness of the bottom electrode layers 152 is smaller than the thickness of the patterned second photoresist layer 132*a* for preventing protrusions respectively formed on the interface between the electrode layers 151, 152 and the photoresist layers 131 and 132. If the protrusions are formed, the air discharge within the gap 166 will be affected by the protrusions. The thicknesses of the electrode layers 151 and the bottom electrode layers 152 are about 3 μm to 30 μm. The materials of the electrode layers 151 and the bottom electrode layers 152 can be conductive materials, such as Cu, Ag, Au, Pt, Ni, Cr and so on.

In this embodiment the electrode layers 151 and the bottom electrode layers 152 are formed simultaneously by the electroplating process, but the invention is not limited to this. The electrode layers 151 and the bottom electrode layers 152 can be formed respectively by the electroplating processes, so that the first seed layer 121 or the second seed layer 122, not intended to be electroplated, should be protected by the dry film or the photoresist. If the electrode layers 151 and the bottom electrode layers 152 are formed respectively, the lithography processes for forming the photoresist layers and the electroplating processes for forming the electrode layers and the bottom electrode layers can be designed according to real (e.g., case determined) needs. For example, after finishing the lithography process of the first photoresist layer 131 and the electroplating process of the electrode layers 151, the lithography process of the second photoresist layer 132 and the electroplating process of the bottom electrode layers 152 can be performed. Furthermore, the patterned third photoresist layer 133*a* and the patterned metal layer 141*a* can be removed after the electroplating process of the electrode layers 151.

Then, referring to FIG. 1J, the patterned first photoresist layer 131*a*, the patterned second photoresist layer 132*a*, the first seed layer 121 under the patterned first photoresist layer 131*a*, and the second seed layer 122 under the patterned second photoresist layer 132*a* are removed to form a gap 166 and an opening 167. The gap 166 is disposed between the electrode layers 151, and the opening 167 is disposed between the bottom electrode layers 152. The gap 166 has a width W that is defined as the shortest distance between the electrode layers 151. The width W is designed by the withstanding voltage specification. In this embodiment, the width W is about 5 μm to 200 μm. Preferably the width W is about 5 μm to 30 μm, and even more preferably the width W is about 5 μm to 20 μm. For example, the electric field for air discharge is about 20 KV/cm. If the width W is about 5 μm to 500 μm, the corresponding withstanding voltage is about 10-1000 V.

Then, referring to FIG. 1K, (G) a sealing layer 171 is formed on the electrode layers 151. The sealing layer 171 is used for sealing the gap 166 so as to prevent the moisture or the particles from entering the gap 166. The air discharge within the gap 166 will be affected by the moisture or the particles. In this embodiment, the sealing layer 171 is formed by the printing process or the coating process. The thickness of the sealing layer 171 is about 5 μm to 30 μm, but the invention is not limited to this. The thickness of the sealing layer 171 is thick enough if the sealing layer 171 is capable of sealing the gap 166 between the electrode layers 151. The sealing layer 171 can be made of a dry film containing a high molecular material or a material with low rheological properties, so that the sealing layer 171 can seal the gap 166 without filling the gap 166. The material with low rheological properties has a high viscosity, for example, the viscosity is about 40 KCPs-150 KCPs. The solvent used in the material can be a volatile solvent. Otherwise, cross-linking agents, adhesion promoters, or rheological control agents can be used for adjusting the rheological properties. The material with low rheological properties can be epoxy resin, polyimide (PI), rosin and so on. Furthermore, the sealing layer 171 can be made of a material with low rheological properties and static conductive functions. For example, the material can include metal particles. The metal particles are capable of adjusting the electric capacity of the over-voltage protection device 100. The metal particles can be made of ZnO, Cu, Ni, or Al. The cross-linking agent can be fumed silica of Cab-O-Sil®, Varox Peroixde, or long-chain polymers such as 2,4-dichlorbenzoyl. The cross-linking agent has two functions. The first function is to prevent the situation in which if the metal particles and the rosin material are not mixed well, precipitation may occur. The second function is to improve the rheological properties. Moreover, the stability of the over-voltage protection device during the over-voltage condition and the static pulse condition can be improved by coating an oxide layer on the metal particle.

Then, referring to FIG. 1L, a protecting layer 172 is formed on the sealing layer 171. The protecting layer 172 can be formed of epoxy resin, polyimide (PI), or acrylic resin by the coating process. In this embodiment, for example, the protecting layer 172 is formed of epoxy resin. The protecting layer 172 covers the sealing layer 171 and a portion of the electrode layers 151 for preventing the over-voltage protection device 100 from being damaged by the environmental factors, such as the temperature or the humidity of the environment.

Then, referring to FIG. 1M, a first end electrode 173 and a second end electrode 174 are formed on the edge surfaces of the substrate 11. The first end electrode 173 and the second end electrode 174 are connected to the electrode layers 151 and the bottom electrode layers 152. In this embodiment, the first end electrode 173 and the second end electrode 174 are formed by the sputtering process. The material of the first end electrode 173 and the second end electrode 174 can be Ni or Cr, but the invention is not limited to this in that the first end electrode 173 and the second end electrode 174 can be made of another material or by another process. For example, the first end electrode 173 and the second end electrode 174 can be made by the ion plating process or the silver dipping process.

Finally, referring to FIG. 1N, a first soldering layer 175 and a second soldering layer 176 are formed on the first end electrode 173 and the second end electrode 174. The first soldering layer 175 and the second soldering layer 176 cover the exposed portion of the electrode layers 151 and the bottom electrode layers 152 respectively. The first soldering layer 175 and the second soldering layer 176 are used as outer electrodes of the over-voltage protection device 100 for connecting to an outer printed circuit board. In this embodiment the first soldering layer 175 and the second soldering layer 176 are formed as Ni/Sn layers by the electroplating process, but the invention is not limited to this. The first soldering layer 175 and the second soldering layer 176 can be made of another material or by another process.

Still referring to FIG. 1N, the over-voltage protection device 100 can be made by the manufacturing method mentioned above. The over-voltage protection device 100 includes a substrate 11, a pair of electrode layers 151, a sealing layer 171, and outer electrodes. The outer electrodes include the first end electrode 173 and the second end electrode 174. The electrode layers 151 are disposed on the substrate 11, wherein a gap 166 is disposed between the electrode layers 151. The edge surface 161 of the electrode layer 151 is adjacent to the gap 166, and the edge surface 161 is smooth and substantially vertical to the substrate 110. The sealing layer 171 covers a portion of the electrode layers 151 and the gap 166 for sealing the gap 166. The outer electrodes, such as the first end electrode 173 and the second end electrode 174, are electrically connected to the electrode layers 151 and the bottom electrode layers 152, respectively.

It should be noted that the method for manufacturing the over-voltage protection device 100 of this embodiment uses the patterned metal layer 141*a* as a mask to replace the mask of the exposing machine used in the conventional manufacturing method. The exposing machine can be a proximity aligner. The first photoresist layer 131 is exposed through the patterned metal layer 141*a* so as to reduce the distance between the mask and the photoresist layer. Therefore, the edge surface of the patterned first photoresist layer 131*a* is more vertical to the substrate 110. The non-vertical profiles made of the positive photoresist and the negative photoresist can be avoided. The electrode layers 151 which are formed through the patterned first photoresist layer 131*a* will have edges surface of better perpendicularity and smoothness. The stability of the withstanding voltage properties, formerly decreased by the roughness of the edge surface of the electrode, can also be avoided. Therefore, better properties of the over-voltage protection device can be achieved.

Furthermore, in this embodiment, the third photoresist layer 133 has a smaller thickness. Therefore, better resolution of the lithography process can be achieved. The edge surface of the patterned third photoresist layer 133*a* is more vertical to the substrate 110. The patterned third photoresist layer 133*a* is used as a mask to form the patterned metal layer 141*a* by etching the metal layer 141. The patterned metal layer 141*a* can be also more vertical to the substrate 110. Finally, the patterned metal layer 141*a* is used as a mask for forming the patterned first photoresist layer 131*a* and forming the electrode layers 151 by the electroplating process. Thus, the edge surface 161 of the electrode layers 151 being adjacent to the gap 166 can be substantially vertical to the substrate 110. Therefore, better properties of the over-voltage protection device can be achieved.

Moreover, in the step of forming the electrode layers 151, the positive photoresist of better resolution and the electroplating process are used for ensuring that the edge surface 161 of the electrode layers 151 is substantially vertical to the substrate 110. Especially when the thickness of the electrode layers 151 is increased and the width W of the gap 166 is decreased, the edge surface 161 of the electrode layers 151 can also be substantially vertical to the substrate 110.

Figure 2A:
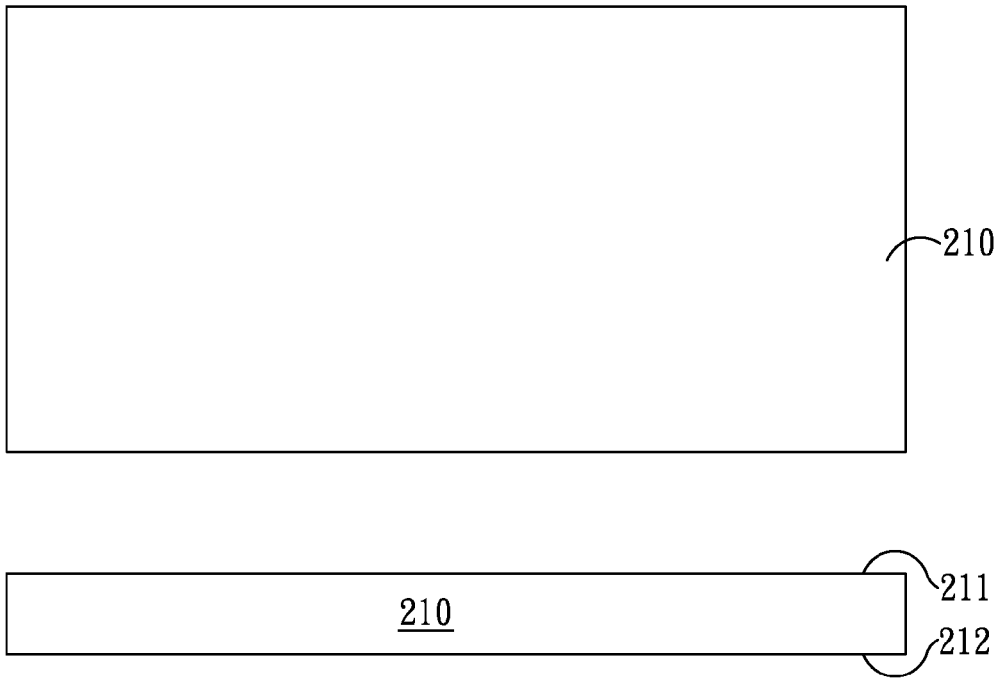
FIGS. 2A-2N elucidate a method for manufacturing an over-voltage protection device in accordance with a second embodiment of the present invention.
Figure 2B:
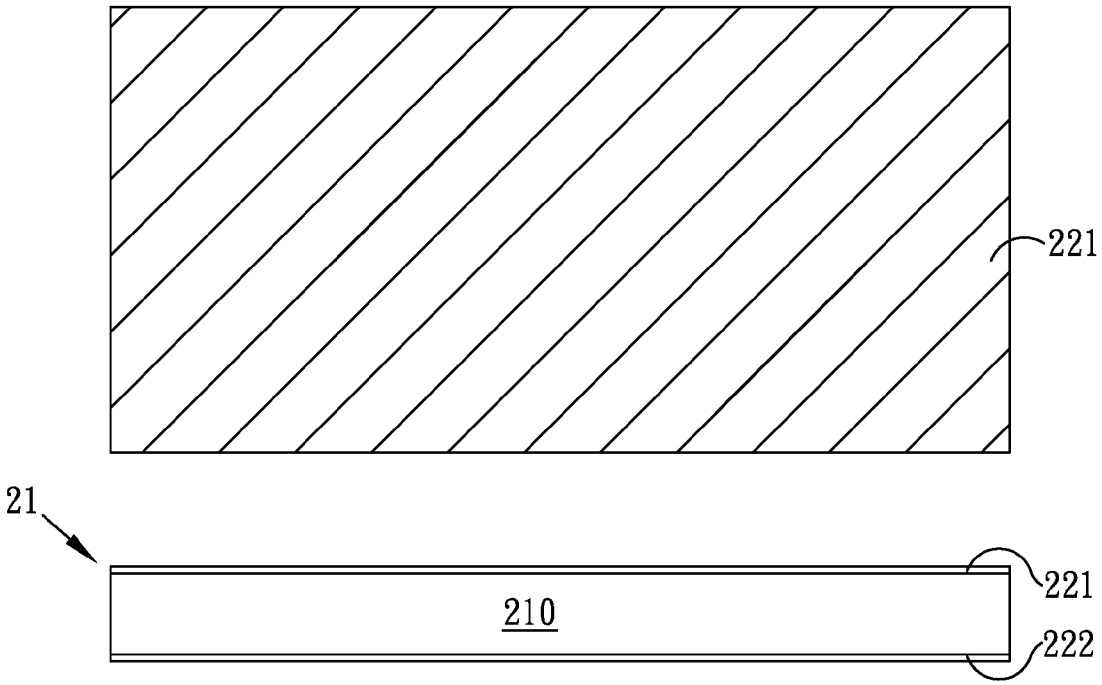
Figure 2C:
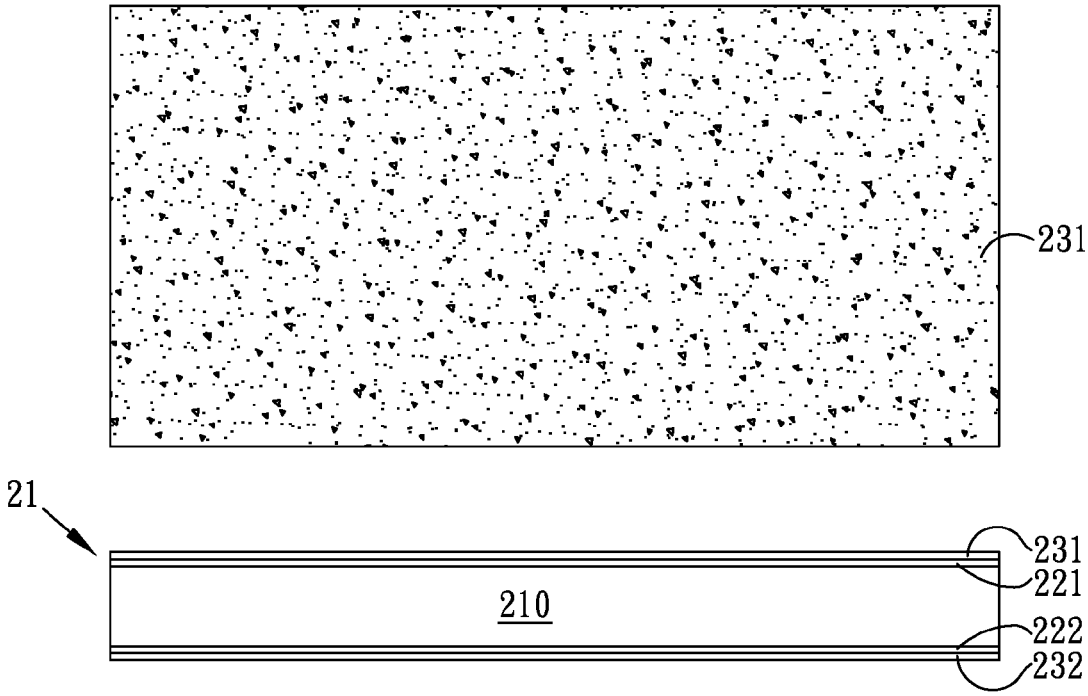
Figure 2D:
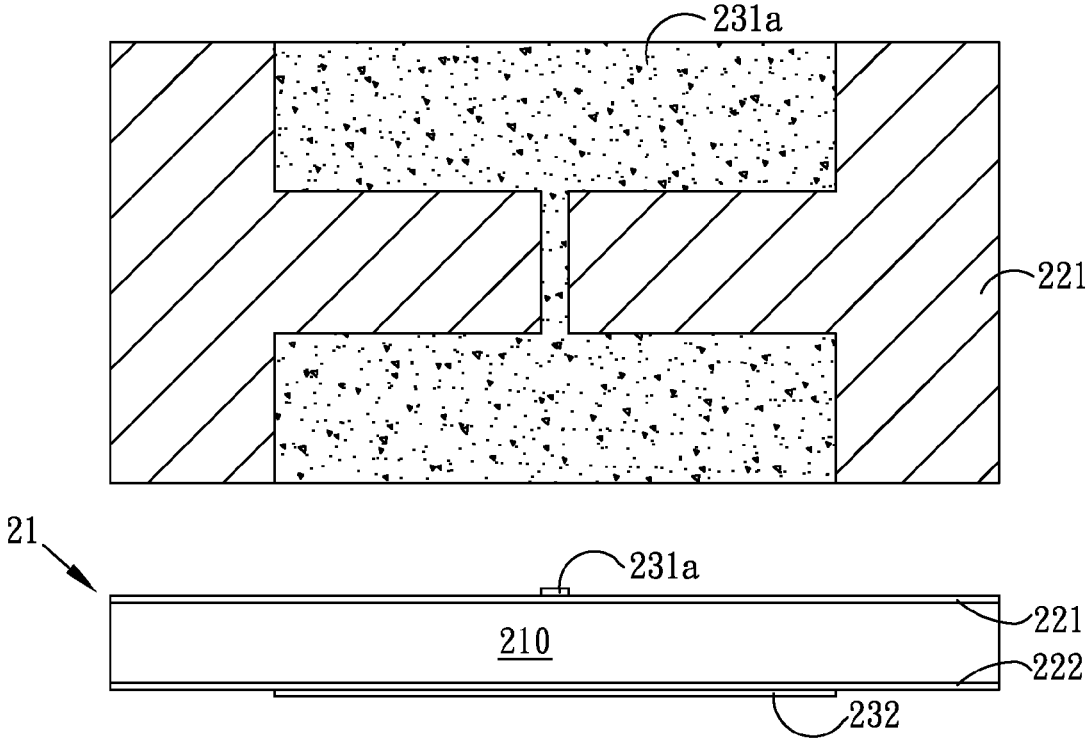
Figure 2E:
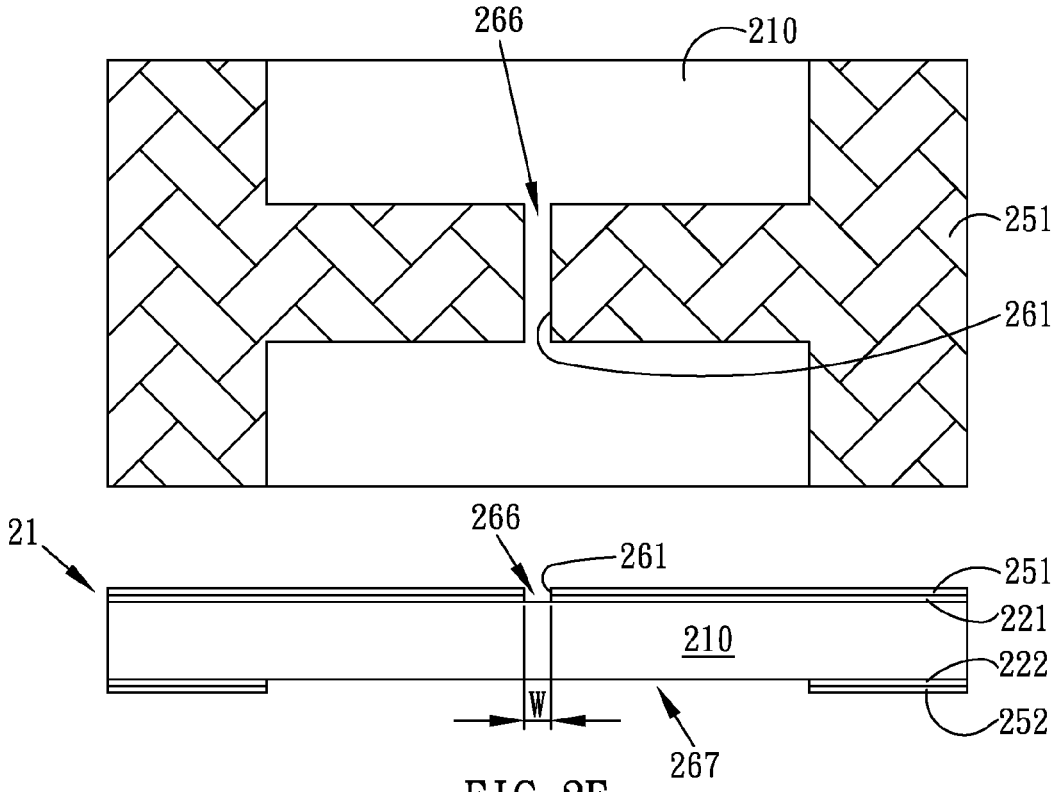
Figure 2F:
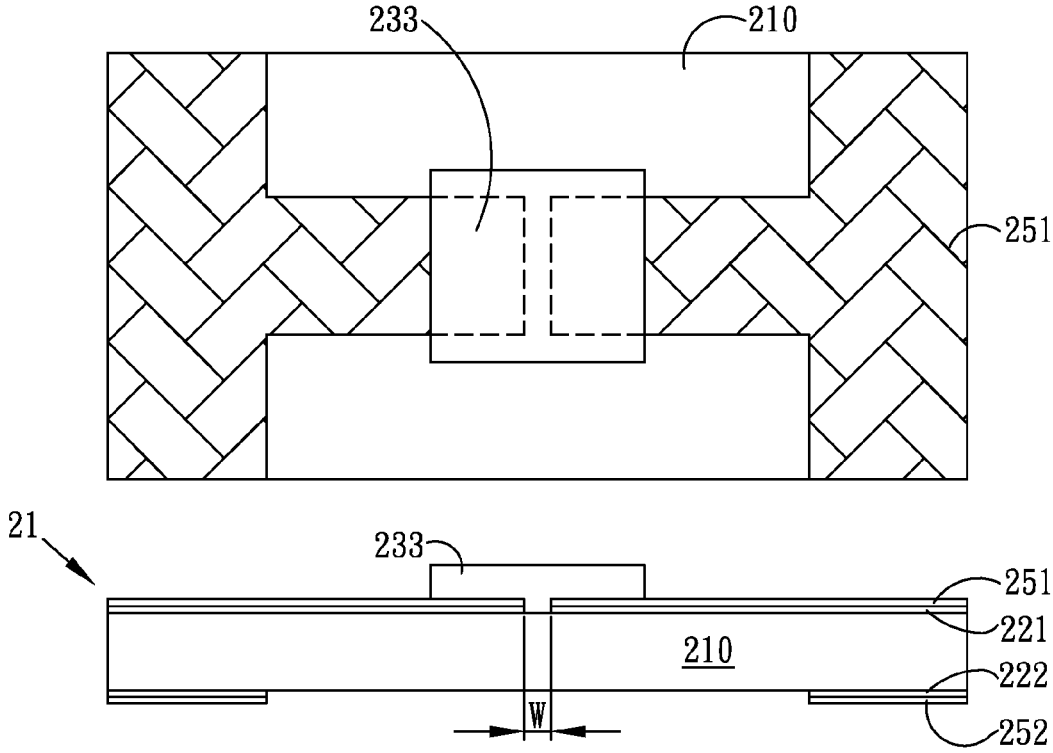
Figure 2G:
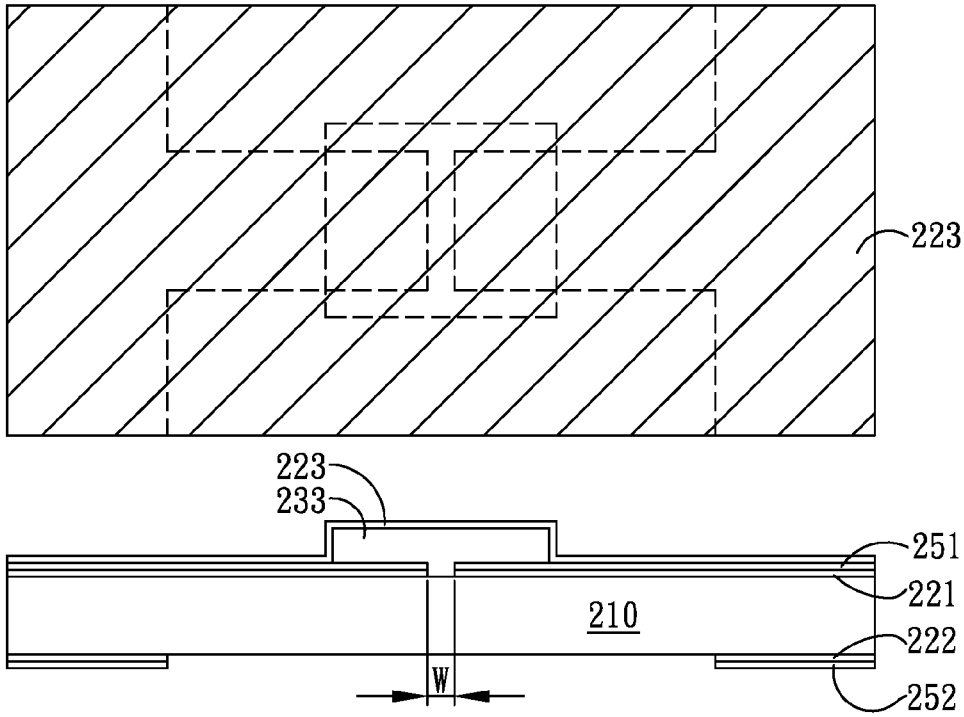
Figure 2H:
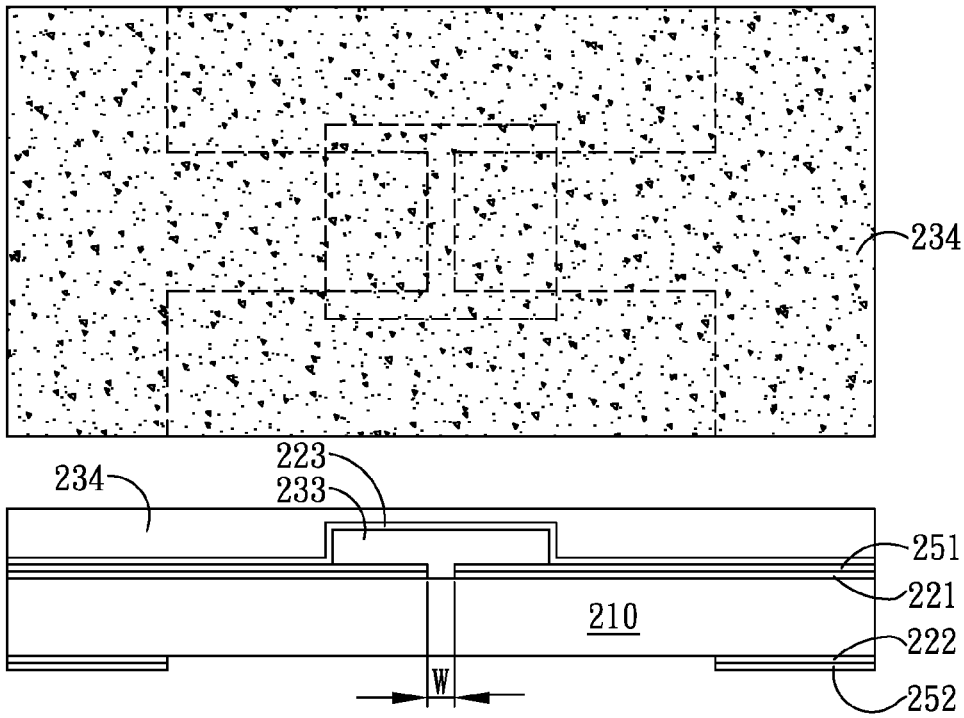
Figure 2I:
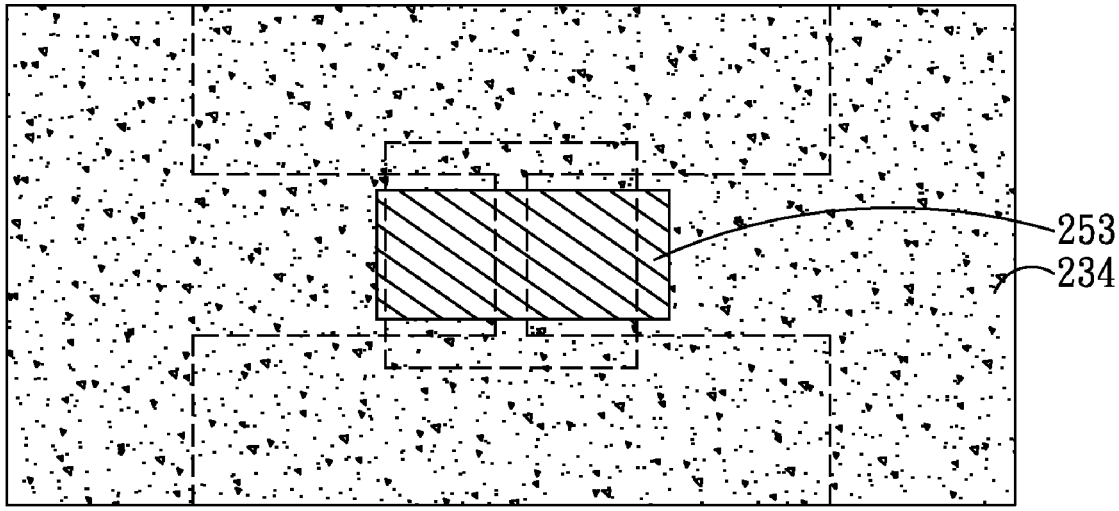
Figure 2I:
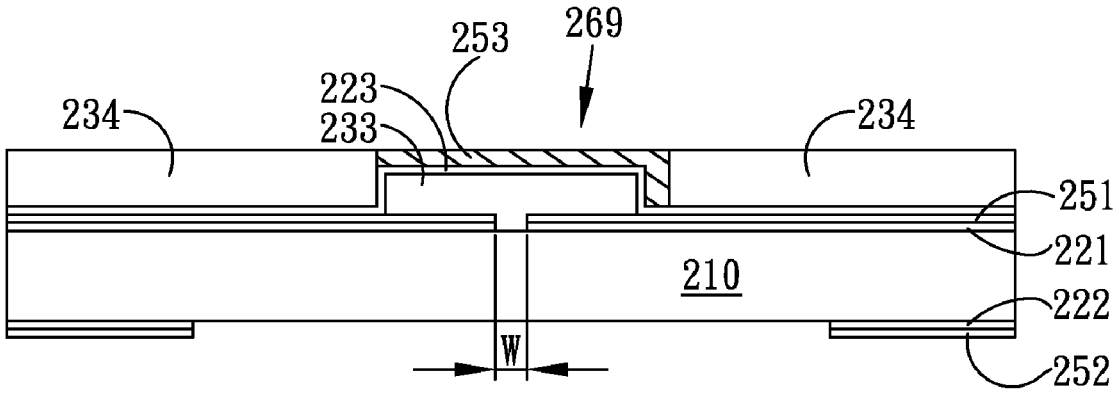
Figure 2J:
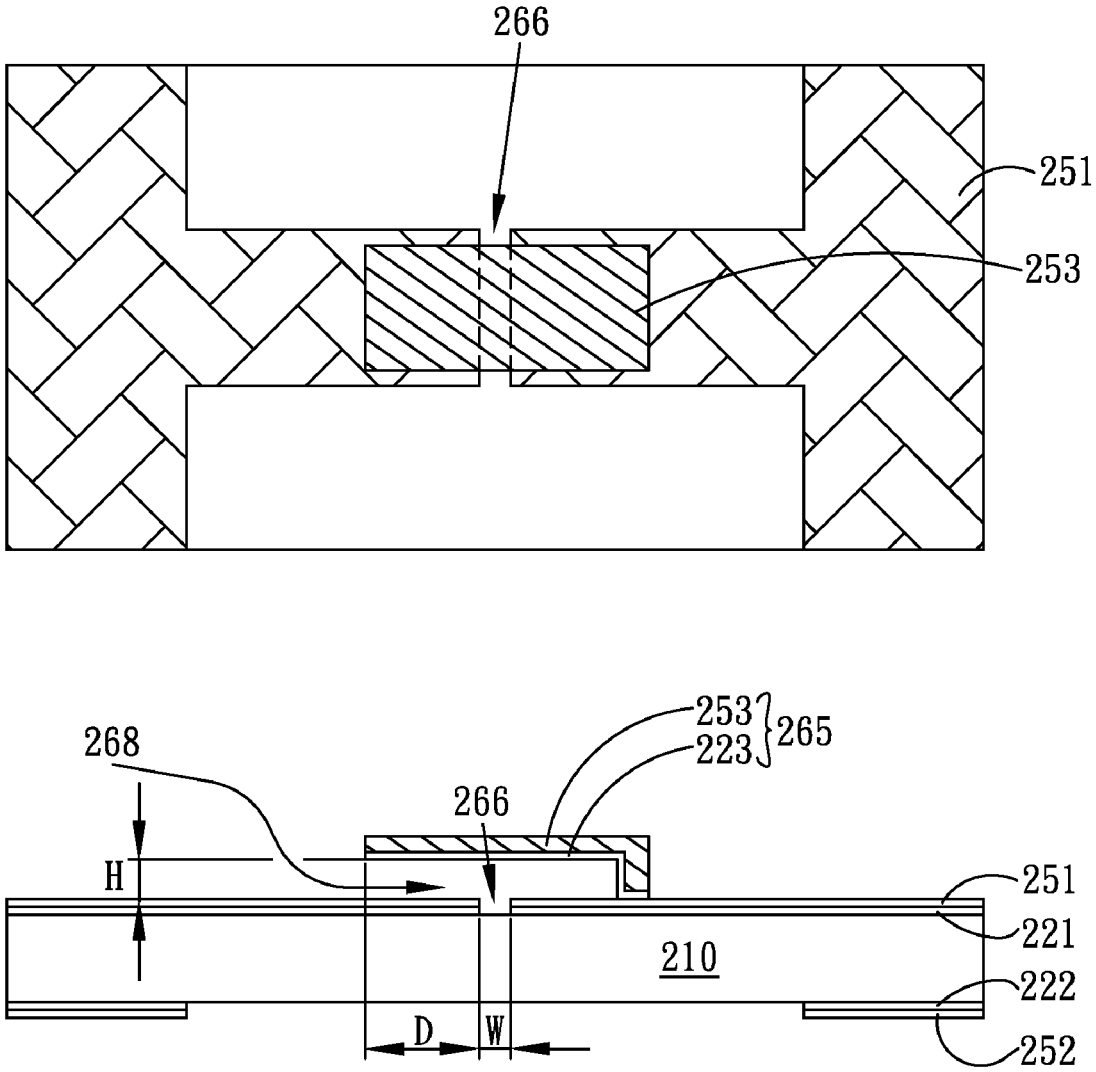
Figure 2K:
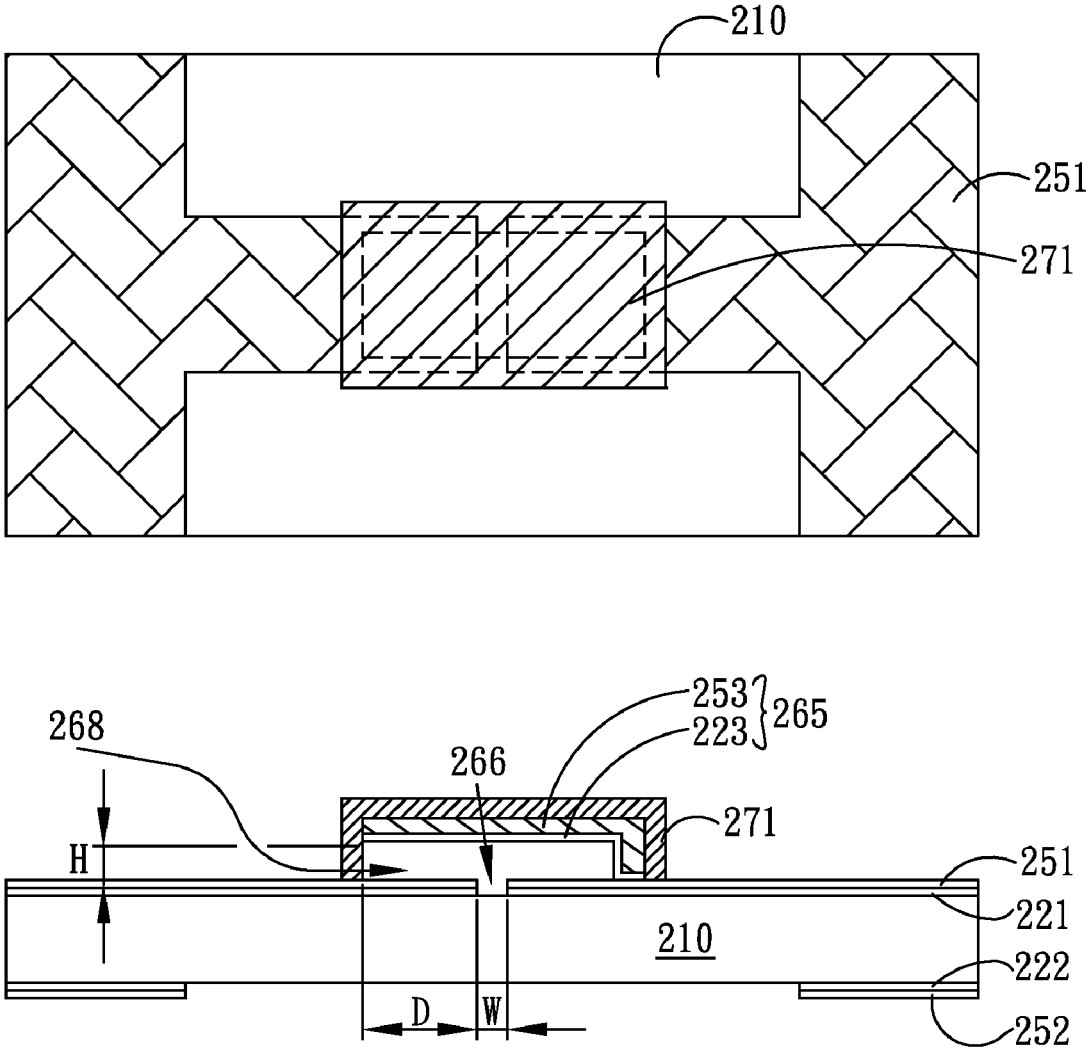
Figure 2L:
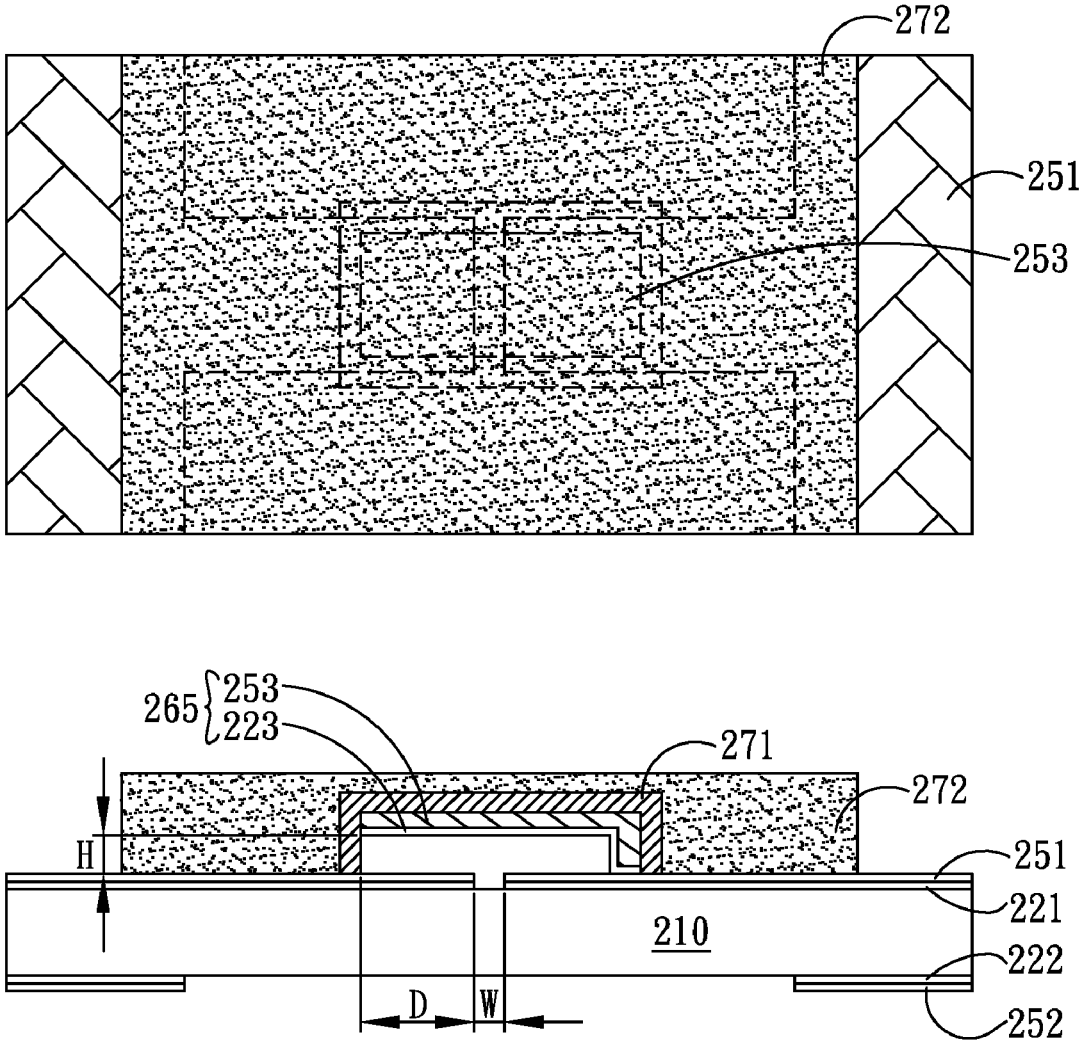
Figure 2M:
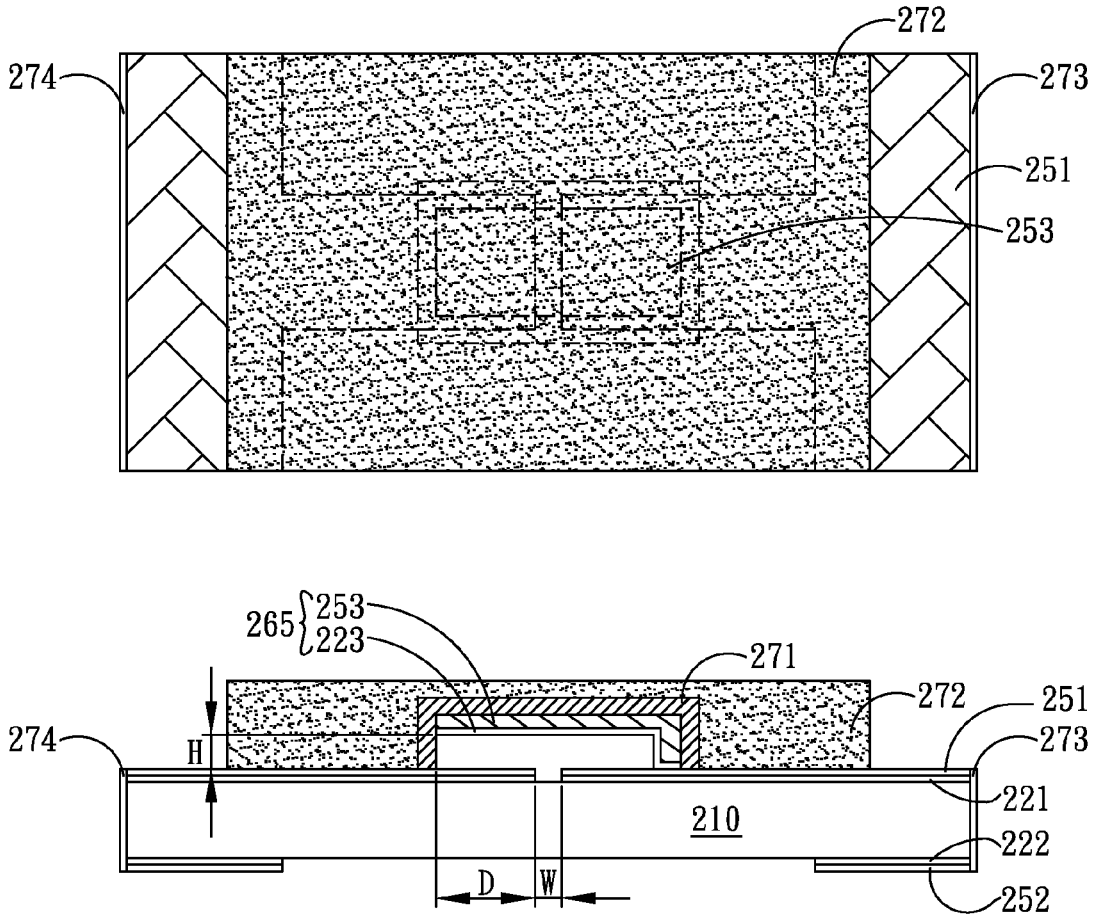
Figure 2N:
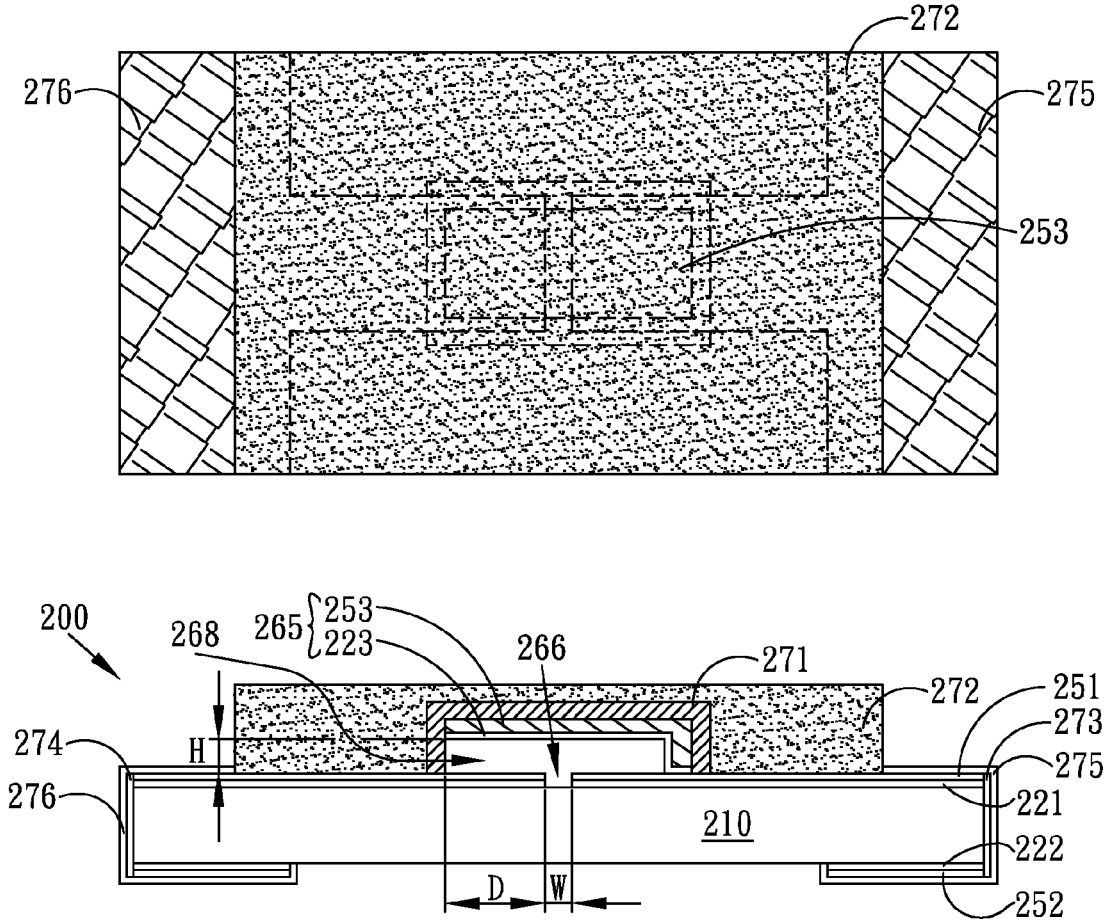

FIGS. 2A-2N illustrate a method for making an over-voltage protection device in accordance with a second embodiment of the present invention. Details on the steps are described in the following paragraphs.

First, providing a substrate 21, referring to FIG. 2A and FIG. 2B, the substrate 21 has a base plate 210, a first seed layer 221, and a second seed layer 222. The connecting relations and materials are the same as the first embodiment of the present invention. Therefore, the same concept is not mentioned again.

Then, referring to FIGS. 2C-2E, a pair of electrode layers 251 is formed on the substrate 21, wherein a gap 266 is between the electrode layers. Referring to FIG. 2C, a first photoresist layer 231 is formed on the first seed layer 221, and a second photoresist layer 232 is formed on the second seed layer 222. Then, referring to FIG. 2D, the first photoresist layer 231 and the second photoresist layer 232 are exposed and developed by the lithography process for forming the patterned first photoresist layer 231*a* and the patterned second photoresist layer 232*a* to expose a portion of the first seed layer 221 and the second seed layer 222. Then, referring to FIG. 2E, a pair of electrode layers 251 is formed on the exposed portion of the first seed layer 221 by the electroplating process, and a pair of bottom electrode layers 252 is formed on the exposed portion of the second seed layer 222 by the electroplating process. Then, the patterned first photoresist layer 231*a*, the patterned second photoresist layer 232*a*, the first seed layer 221 under the patterned first photoresist layer 231*a*, and the second seed layer 222 under the patterned second photoresist layer 232*a* are removed to form a gap 266 and an opening 267. The gap 266 is disposed between the electrode layers 251, and the opening 267 is disposed between the bottom electrode layers 252. The detailed manufacturing process can be referred to in the first embodiment, so the same concept is not mentioned again.

Furthermore, the electrode layers 251 can be formed by the manufacturing method of the first embodiment shown in FIGS. 1C-1J. Compared to the manufacturing method shown in FIGS. 2C-2E, the electrode layers 251 formed by the manufacturing method shown in FIGS. 1C-1J will have an edge surface which is smoother and/or more vertical to the substrate 21.

Then, referring to FIGS. 2F-2J, a mask layer 265 is formed over the gap 266 and a portion of the electrode layers 251, whereby the mask layer 265 has a substantially L-shaped cross section. For example, a third photoresist layer 233 is formed on a portion of the electrode layers 251, and the gap 266 is covered by the third photoresist layer 233, as shown in FIG. 2F. Then, referring to FIG. 2G, a third seed layer 223 is formed on the third photoresist layer 233 and the electrode layers 251 by the sputtering process. The material of the third seed layer 223 should be different from the material of the electrode layers 251 for preventing the electrode layers 251 from being removed in the etching process of the third seed layer 223. In this embodiment the material of the electrode layers 251 is Cu with the material of the third seed layer 223 being Ti—W alloy, but the invention is not limited to this.

Then, referring to FIG. 2H, a fourth photoresist layer 234 is formed on the third seed layer 223. Then, referring to FIG. 2I, the fourth photoresist layer 234 is exposed and developed for forming an opening 269 and exposing a portion of the third seed layer 223. The space of the opening 269 has a substantially L-shaped cross section. Then, an electroplating layer 253 is formed within the opening 269. In this embodiment the material of the electrode layers 253 is Cu with the material of the third seed layer 223 being Ti—W alloy, but the invention is not limited to this. Finally, referring to FIG. 2J, the fourth photoresist layer 234 and the third photoresist layer 233 are removed by the developing process, and a portion of the third seed layer 223 is removed by the etching process to form the mask layer 265 that is composed of the electroplating layer 253 and a portion of the third seed layer 223. It is noted that the mask layer 265 has a substantially L-shaped cross section, with a clearance 268 being disposed between the mask layer 265 and the electrode layers 251. The mask layer 265 covers one of the electrode layers 251. The span D is defined as the dimension at which the mask layer 265 covers the electrode layers 251, and the height H of the clearance 268 is defined as the distance between the third seed layer 223 and the electrode layers 251 in the vertical direction. In this embodiment, the height H of the clearance 268 is greater than the width W of the gap 266. Preferably the height H of the clearance 268 is twice the width W of the gap 266 so as to make the point discharge occur within the gap 266.

Furthermore, if the material of the mask layer 265 is different from the material of the electrodes 251, the electroplating layer 253 can be omitted, and the third seed layer 223 can be used as the mask layer 265.

Then, referring to FIG. 2K and FIG. 2L, a sealing layer 271 and a protecting layer 272 are formed on the mask layer 265 respectively. Finally, referring to FIG. 2M and FIG. 2N, a first end electrode 273, a second end electrode 274, a first soldering layer 275, and a second soldering layer 276 are formed respectively. The detailed manufacturing process can be referred to in the first embodiment; therefore, the same concept is not mentioned again.

Referring to FIG. 2N, the over-voltage protection device 200 can be made by the manufacturing method mentioned above. The over-voltage protection device 200 includes a substrate 21, a pair of electrode layers 251, a mask layer 265, and a sealing layer 271. The electrode layers 251 are disposed on the substrate 21, wherein a gap 266 is disposed between the electrode layers 251. The mask layer 265 is disposed over the gap 266 and a portion of the electrode layers 251, wherein the mask layer 265 has a substantially L-shaped cross section. The sealing layer 271 covers the mask layer 265 and the gap 266.

In this embodiment, the mask layer 265 is used to prevent the material of the sealing layer 271 from entering the gap 266 that is disposed between the electrode layers 251. Although the material of the sealing layer 271 may enter the space between the mask layer 265 and the electrode layers 251 through the opening 268, the material of the sealing layer 271 will not enter the gap 266 because the span D of the mask layer 265 has enough distance. Therefore, materials with the exception of air will not be retained within the gap 266 so as to achieve better properties of the over-voltage protection device.

Figure 3A:
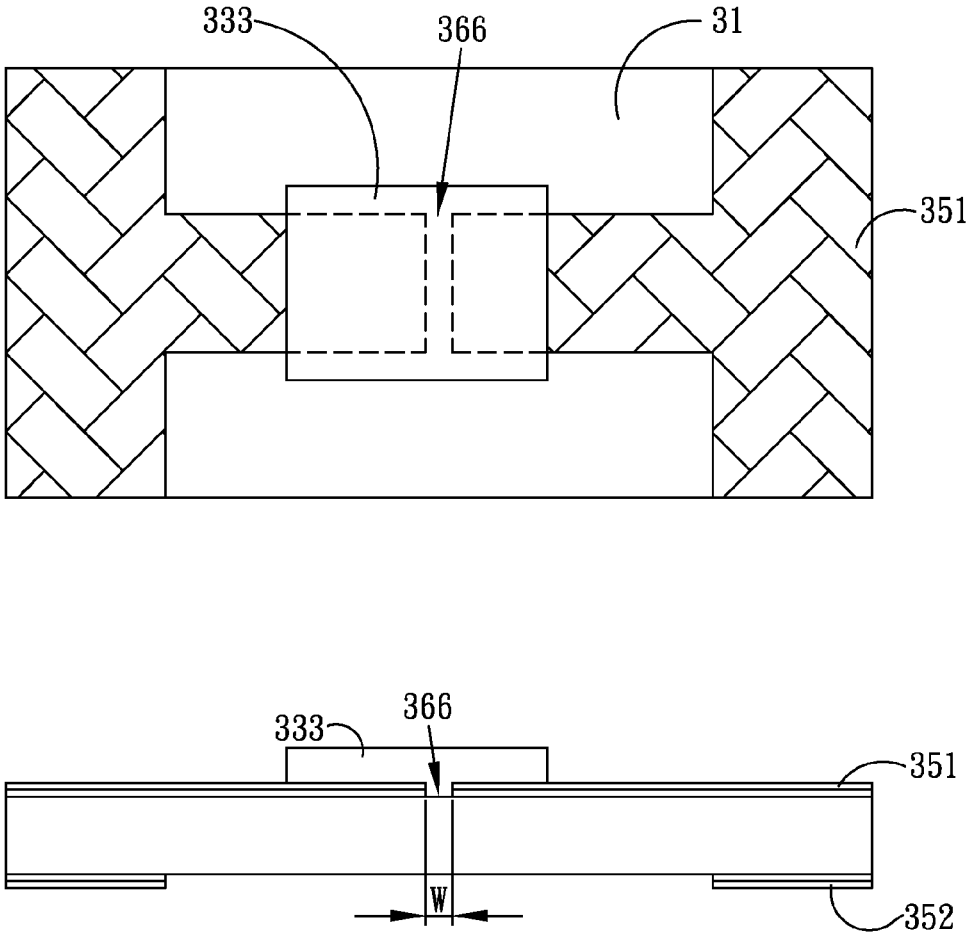
FIGS. 3A-3D illustrate steps of a method for manufacturing an over-voltage protection device in accordance with a third embodiment of the present invention.
Figure 3B:
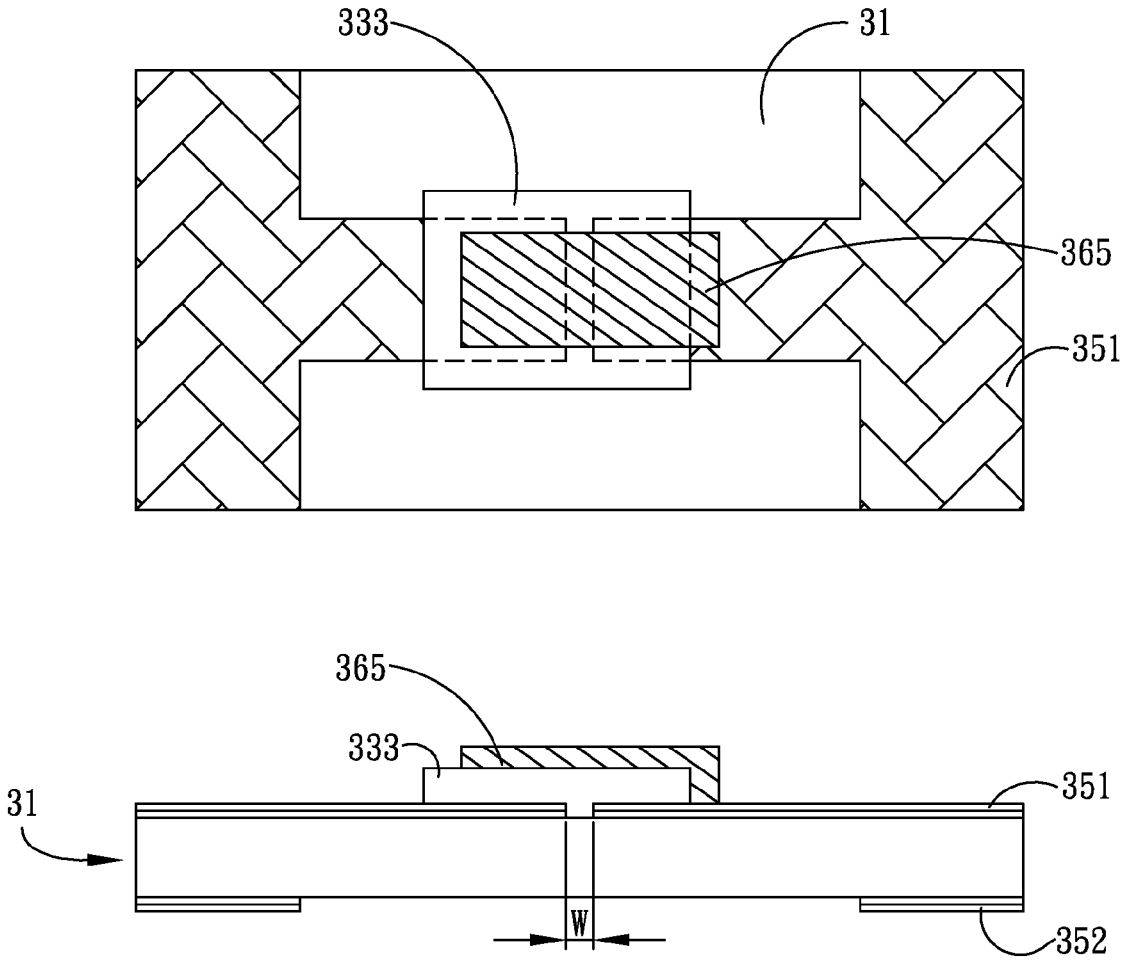
Figure 3C:
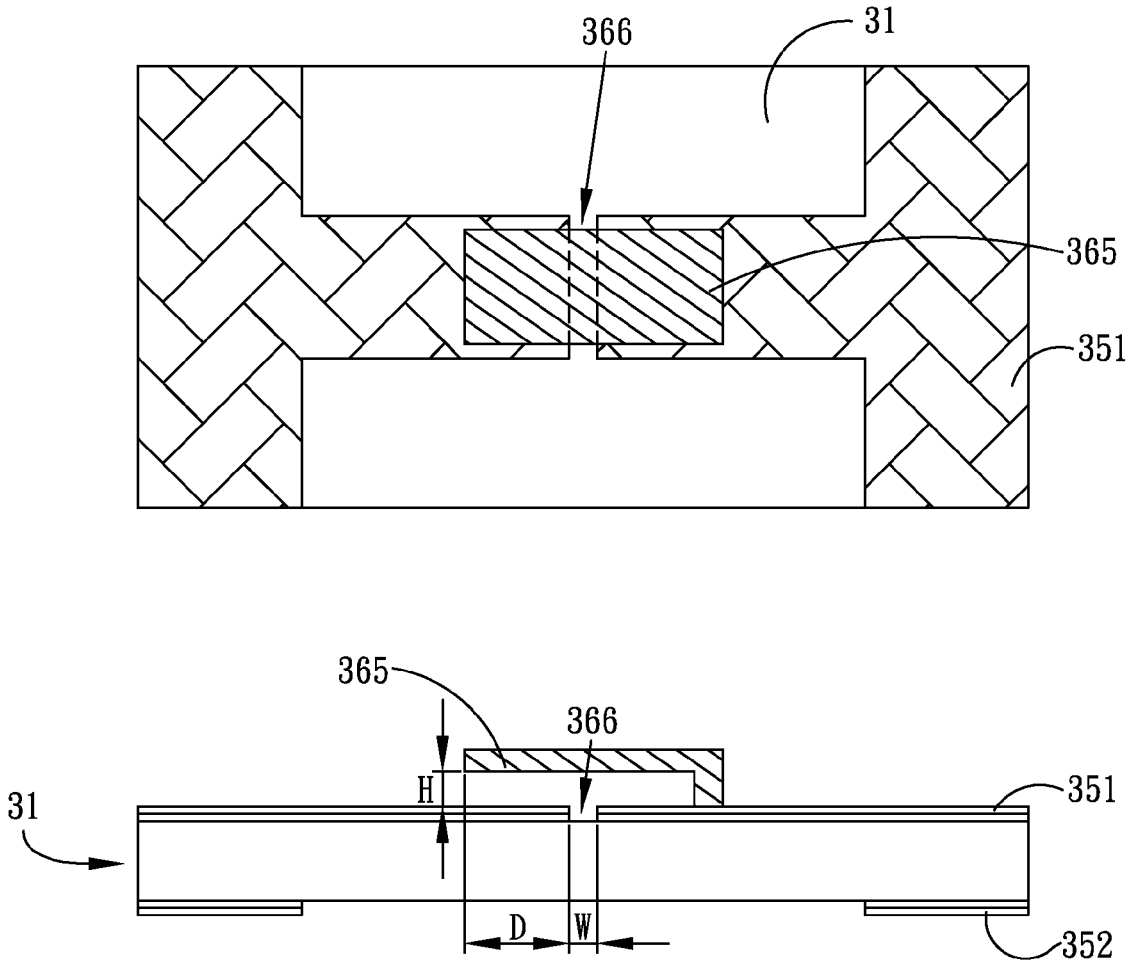

FIGS. 3A-3D elucidate a method for manufacturing an over-voltage protection device in accordance with a third embodiment of the present invention. The difference between the second embodiment and the third embodiment is the manufacturing method of the mask layer 365. In order to make the specification clear, the element numerals of the third embodiment are similar to the element numerals of the second embodiment, such as the substrate 31, the electrode layers 351, the bottom electrode layer 352, the sealing layer 371, the protecting layer 372, the first end electrode 373, the second end electrode 374, the first soldering layer 375, and the second soldering layer 375. The detailed manufacturing process can be referred to in the first embodiment and in the second embodiment, so the same concept is not mentioned again. The manufacturing method of the mask layer 365 is shown in FIGS. 3A-3C. First, referring to FIG. 3A, a third photoresist layer 333 is formed for covering the gap 366 that is disposed between the electrode layers 351. Then, referring to FIG. 3B, a mask layer 365 is formed on the third photoresist layer 333. The mask layer 365 can be formed by the printing process, such as the thick film printing process. In this embodiment, the mask layer 365 comprises a low-temperature hardening material so as to prevent the situation of the properties of the third photoresist layer 333 being affected by the high temperature of the hardening process of the mask layer 365 whereby removal of the third photoresist layer 333 becomes difficult. For example, the material of the mask layer 365 can comprise one or more of room-temperature hardening resins, UV-light curing resins and electron-beam curing resins, such as acrylic resins, epoxy resins, acrylated epoxy resins, acrylated polyesters, acrylated acrylic resins and so on. Then, referring to FIG. 3C, the third photoresist layer 333 is removed, with the mask layer 365 having a substantially L-shaped cross section being disposed over the gap 366 and a portion of the electrode layers 351. The manufacturing method of the mask layer 365 can be simplified by the processes mentioned above.

Figure 3D:
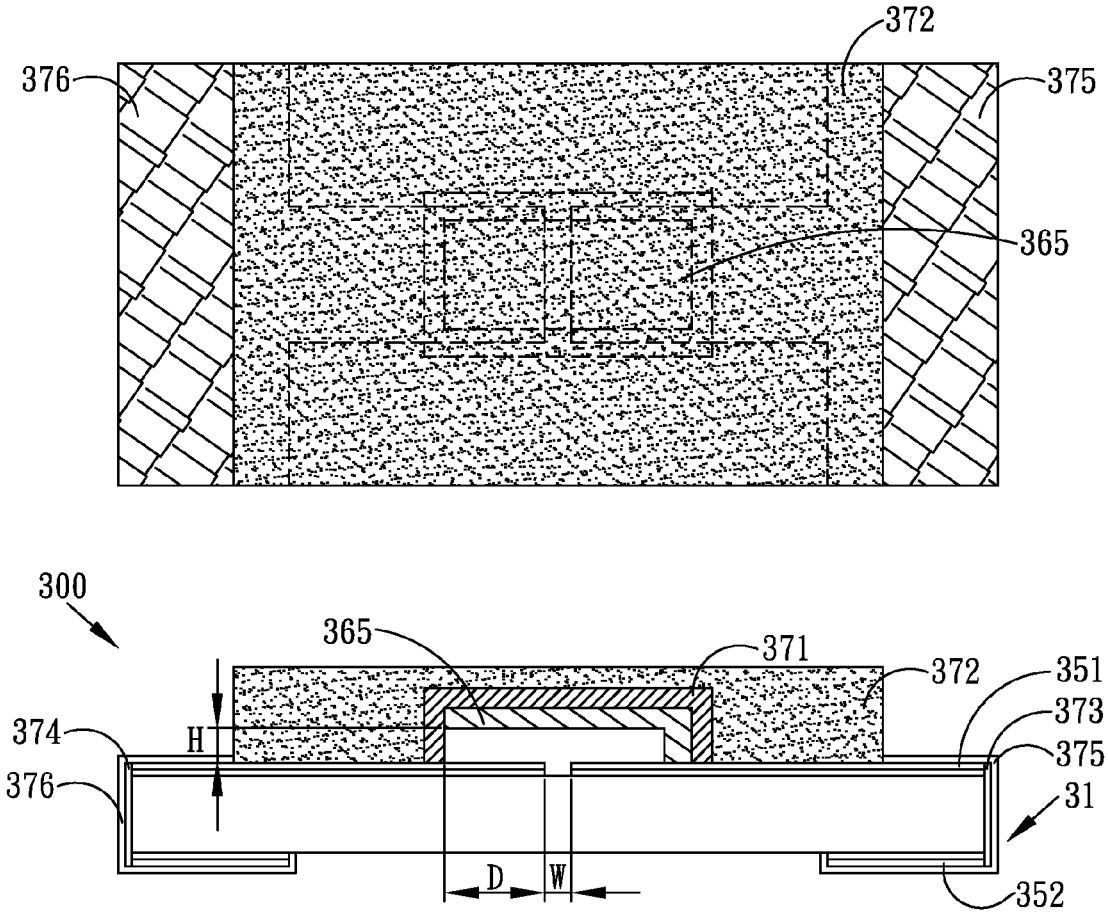

Then, a sealing layer 371, a protecting layer 372, a first end electrode 373, a second end electrode 374, a first soldering layer 375, and a second soldering layer 376 are formed respectively for manufacturing the over-voltage protection device 300, as shown in FIG. 3D. The detailed manufacturing process can be referred to in the first embodiment and in the second embodiment, so the same concept is not mentioned again.

Although specific embodiments have been illustrated and described, it will be appreciated by those skilled in the art that various modifications may be made without departing from the scope of the present invention, which is intended to be limited solely by the appended claims.

What is claimed is:

1. A method for manufacturing an over-voltage protection device, comprising:

providing a substrate;

forming a first photoresist layer on said substrate;

forming a patterned metal layer on said first photoresist layer;

exposing and developing said first photoresist layer to expose a portion of said substrate, whereby said patterned metal layer is used as a mask;

removing said patterned metal layer;

forming a pair of electrode layers on said exposed portion of said substrate, whereby a gap is disposed between said electrode layers; and forming a sealing layer covering said gap.

2. The method for manufacturing an over-voltage protection device according to claim 1, wherein said sealing layer comprises a material with low rheological properties.

3. The method for manufacturing an over-voltage protection device according to claim 1, wherein said sealing layer comprises a material having low rheological properties and static conductive functions.

4. The method for manufacturing an over-voltage protection device according to claim 1, wherein said forming of said patterned metal layer on said first photoresist layer comprises:

forming a metal layer on said first photoresist layer;

forming a third photoresist layer on said metal layer;

exposing and developing said third photoresist layer to expose a portion of said metal layer, whereby said exposed portion of said metal layer has electrode patterns which are separated from and symmetrical to each other and which are substantially identical to said electrode layers; and removing said exposed portion of said metal layer to form said patterned metal layer.

5. The method for manufacturing an over-voltage protection device according to claim 4, wherein said forming of said metal layer comprises forming a copper layer by an evaporation process.

6. The method for manufacturing an over-voltage protection device according to claim 4, wherein said first photoresist layer comprises a positive photoresist and is thicker than said third photoresist layer.

7. The method for manufacturing an over-voltage protection device according to claim 1, wherein said forming of said pair of electrode layers on said exposed portion of said substrate comprises:

electroplating a metal layer on said exposed portion of said substrate; and removing said first photoresist layer to form said gap between said electrode layers, said electrode layers being separated from and symmetrical to each other.

8. The method for manufacturing an over-voltage protection device according to claim 1, wherein said forming of said pair of electrode layers on said exposed portion of said substrate comprises forming said electrode layer with an edge surface that is substantially vertical to said substrate and adjacent to said gap.

9. The method for manufacturing an over-voltage protection device according to claim 1, wherein the thickness of said patterned metal layer is about 0.03 μm to 0.05 μm.

10. The method for manufacturing an over-voltage protection device according to claim 1, wherein the width of said gap is about 5 μm to 200 μm.

11. An over-voltage protection device, comprising:

a substrate;

a pair of electrode layers disposed on said substrate, wherein a gap is formed between said electrode layers;

a mask layer disposed over said gap and a portion of said electrode layers, wherein a clearance exists between said mask layer and said electrode layers; and a sealing layer covering said mask layer and said gap.

12. The over-voltage protection device according to claim 11, wherein the height of said clearance is longer than the width of said gap.

13. The over-voltage protection device according to claim 11, wherein said electrode layer has an edge surface, said edge surface being substantially vertical to said substrate and adjacent to said gap.

14. The over-voltage protection device according to claim 11, wherein said mask layer has a substantially L-shaped cross section.

15. A method for manufacturing an over-voltage protection device, comprising:

providing a substrate;

forming a pair of electrode layers on said substrate, wherein a gap exists between said electrode layers;

forming a mask layer over said gap and a portion of said electrode layers; and forming a sealing layer covering said mask layer and said gap.

16. The method for manufacturing an over-voltage protection device according to claim 15, wherein said substrate includes a first seed layer and a second seed layer, and said forming of said mask layer comprises:

forming a third photoresist layer covering said gap;

forming a third seed layer on said third photoresist layer;

forming a fourth photoresist layer on said third seed layer;

exposing and developing said fourth photoresist layer to form an opening;

forming an electroplating layer within said opening; and removing said fourth photoresist layer, a portion of said third seed layer, and said third photoresist layer to form said mask layer.

17. The method for manufacturing an over-voltage protection device according to claim 15, wherein said forming of said mask layer comprises:

forming a third photoresist layer covering said gap;

forming a printing layer on said third photoresist layer using a printing process; and removing said third photoresist layer.

18. The method for manufacturing an over-voltage protection device according to claim 17, wherein said mask layer comprises a low-temperature hardening material.

19. The method for manufacturing an over-voltage protection device according to claim 15, wherein said forming of said pair of electrode layers on said substrate comprises:

forming a first photoresist layer on said substrate;

patterning said first photoresist layer to expose a portion of said substrate;

forming said pair of electrode layers on said exposed portion of said substrate; and removing said first photoresist layer.

20. The method for manufacturing an over-voltage protection device according to claim 15, wherein said forming of said pair of electrode layers on said substrate comprises:

forming a first photoresist layer on said substrate;

forming a patterned metal layer on said first photoresist layer;

exposing and developing said first photoresist layer to expose a portion of said substrate, wherein said patterned metal layer is used as a mask;

removing said patterned metal layer;

forming said pair of electrode layers on said exposed portion of said substrate; and removing said first photoresist layer.

* * * * *